US008109004B2

(12) United States Patent
Shenderovich et al.

(10) Patent No.: US 8,109,004 B2
(45) Date of Patent: Feb. 7, 2012

(54) CONSTANT FORCE MECHANICAL SCRIBERS AND METHODS FOR USING SAME IN SEMICONDUCTOR PROCESSING APPLICATIONS

(75) Inventors: Alex Shenderovich, San Francisco, CA (US); Boris Djurovic, San Jose, CA (US); Daniel Liu, Milpitas, CA (US); Wen Chang, Sunnyvale, CA (US); Benyamin Buller, Sylvania, OH (US); Erel Milshtein, Cupertino, CA (US)

(73) Assignee: Solyndra LLC, Fremont, CA (US)

( * ) Notice: Subject to any disclaimer, the term of this patent is extended or adjusted under 35 U.S.C. 154(b) by 0 days.

(21) Appl. No.: 13/014,286

(22) Filed: Jan. 26, 2011

(65) Prior Publication Data

US 2011/0132170 A1 Jun. 9, 2011

Related U.S. Application Data

(63) Continuation of application No. 12/727,184, filed on Mar. 18, 2010, now Pat. No. 7,877,881, which is a continuation of application No. 12/252,354, filed on Oct. 15, 2008, now Pat. No. 7,707,732.

(60) Provisional application No. 60/980,372, filed on Oct. 16, 2007.

(51) Int. Cl.
*B43L 13/00* (2006.01)

(52) U.S. Cl. ..... 33/18.1; 33/21.1

(58) Field of Classification Search ..... 33/18.1, 33/21.1, 21.4, 27.01, 32.1, 32.3
See application file for complete search history.

(56) References Cited

U.S. PATENT DOCUMENTS

| | | | | |
|---|---|---|---|---|
| 2,702,393 | A | 2/1955 | Merton | |
| 3,222,963 | A | 12/1965 | Nabiullin et al. | |
| 3,230,625 | A | 1/1966 | Meyer | |
| 4,153,383 | A | 5/1979 | De Lanauze | |
| 4,226,153 | A | 10/1980 | Insolio | |
| 4,466,193 | A | 8/1984 | Astle | |
| 5,164,009 | A | 11/1992 | Chandler | |
| 5,349,759 | A | 9/1994 | Anton et al. | |
| 5,383,277 | A | 1/1995 | Shimoda et al. | |
| 7,707,732 | B2 * | 5/2010 | Shenderovich et al. | 33/18.1 |
| 7,877,881 | B2 * | 2/2011 | Shenderovich et al. | 33/18.1 |
| 2004/0055634 | A1 | 3/2004 | Yamaguchi | |
| 2006/0064885 | A1 | 3/2006 | McKay et al. | |
| 2007/0180715 | A1 | 8/2007 | Nishio | |

* cited by examiner

*Primary Examiner* — G. Bradley Bennett

(74) *Attorney, Agent, or Firm* — Morgan Lewis & Bockius LLP; Brett Lovejoy

(57) ABSTRACT

A scribing system comprising a mounting mechanism, stylus, and force generating mechanism is provided. The mounting mechanism is configured to rotate an elongated object in such a manner that the object is subjected to a bow effect wherein a middle portion of the object bends relative to the end portions of the object. The stylus is for scribing the object at a position x along the long dimension of the object while the mounting mechanism rotates the object. The force generating mechanism is connected to the stylus so that the stylus applies the same constant force to the elongated object regardless of the position x along the long dimension of the object that the stylus is positioned, while the mounting mechanism rotates the object and thereby subjects the object to the bow effect, thereby scribing the object.

67 Claims, 7 Drawing Sheets

CONSTANT FORCE MECHANICAL SCRIBERS AND METHODS FOR USING SAME IN SEMICONDUCTOR PROCESSING APPLICATIONS

CROSS REFERENCE TO RELATED APPLICATION

This application claims priority to U.S. Provisional Patent Application No. 60/980,372, filed Oct. 16, 2007, which is hereby incorporated by reference herein in its entirety.

1. FIELD OF THE APPLICATION

This application relates to constant force mechanical scribers and their use in semiconductor processing applications.

2. BACKGROUND OF THE APPLICATION

The solar cells of photovoltaic modules are typically fabricated as separate physical entities with light gathering surface areas on the order of 4-6 $cm^2$ or larger. For this reason, it is standard practice for power generating applications to mount photovoltaic modules containing one or more solar cells in a flat array on a supporting substrate or panel so that their light gathering surfaces provide an approximation of a single large light gathering surface. Also, since each solar cell itself generates only a small amount of power, the required voltage and/or current is realized by interconnecting the solar cells of the module in a series and/or parallel matrix.

A conventional prior art photovoltaic module 10 is shown in FIG. 1. A photovoltaic module 10 can typically have one or more photovoltaic cells (solar cells) 12*a-b* disposed within it. Because of the large range in the thickness of the different layers in a solar cell 12, they are depicted schematically. Moreover, FIG. 1 is highly schematic so that it represents the features of both "thick-film" solar cells 12 and "thin-film" solar cells 12. In general, solar cells 12 that use an indirect band gap material to absorb light are typically configured as "thick-film" solar cells 12 because a thick film of the absorber layer is required to absorb a sufficient amount of light. Solar cells 12 that use a direct band gap material to absorb light are typically configured as "thin-film" solar cells 12 because only a thin layer of the direct band-gap material is needed to absorb a sufficient amount of light.

The arrows at the top of FIG. 1 show the source of direct solar illumination on the photovoltaic module 10. Layer 102 of a solar cell 12 is the substrate. Glass or metal is a common substrate. In some instances, there is an encapsulation layer (not shown) coating the substrate 102. In some embodiments, each solar cell 12 in the photovoltaic module 10 has its own discrete substrate 102 as illustrated in FIG. 1. In other embodiments, there is a substrate 102 that is common to all or many of the solar cells 12 of the photovoltaic module 10.

Layer 104 is the back electrical contact for a solar cell 12 in photovoltaic module 10. Layer 106 is the semiconductor absorber layer of a solar cell 12 in photovoltaic module 10. In a given solar cell 12, back electrical contact 104 makes ohmic contact with the absorber layer 106. In many but not all cases, absorber layer 106 is a p-type semiconductor. The absorber layer 106 is thick enough to absorb light. Layer 108 is the semiconductor junction partner that, together with semiconductor absorber layer 106, completes the formation of a p-n junction of a solar cell 12. A p-n junction is a common type of junction found in solar cells 12. In p-n junction based solar cells 12, when the semiconductor absorber layer 106 is a p-type doped material, the junction partner 108 is an n-type doped material. Conversely, when the semiconductor absorber layer 106 is an n-type doped material, the junction partner 108 is a p-type doped material. Generally, the junction partner 108 is much thinner than the absorber layer 106. The junction partner 108 is highly transparent to solar radiation. The junction partner 108 is also known as the window layer, since it lets the light pass down to the absorber layer 106.

In a typical thick-film solar cell, absorber layer 106 and window layer 108 can be made from the same semiconductor material but have different carrier types (dopants) and/or carrier concentrations in order to give the two layers their distinct p-type and n-type properties. In thin-film solar cells in which copper-indium-gallium-diselenide (CIGS) is the absorber layer 106, the use of CdS to form junction partner 108 has resulted in high efficiency cells. Other materials that can be used for junction partner 108 include, but are not limited to, $In_2Se_3$, $In_2S_3$, ZnS, ZnSe, CdInS, CdZnS, $ZnIn_2Se_4$, $Zn_{1-x}Mg_xO$, CdS, $SnO_2$, ZnO, $ZrO_2$ and doped ZnO.

In a typical thick-film solar cells 12, the absorber layer 106 and the window layer 108 can be made from the same semiconductor material but have different carrier types (dopants) and/or carrier concentrations in order to give the two layers their distinct p-type and n-type properties. In thin-film solar cells 12 in which copper-indium-gallium-diselenide (CIGS) is the absorber layer 106, the use of CdS to form the junction partner 108 has resulted in high efficiency photovoltaic devices. The layer 110 is the counter electrode, which completes the functioning solar cell 12. The counter electrode 110 is used to draw current away from the junction since the junction partner 108 is generally too resistive to serve this function. As such, the counter electrode 110 should be highly conductive and transparent to light. The counter electrode 110 can in fact be a comb-like structure of metal printed onto the layer 108 rather than forming a discrete layer. The counter electrode 110 is typically a transparent conductive oxide (TCO) such as doped zinc oxide. However, even when a TCO layer is present, a bus bar network 114 is typically needed in conventional photovoltaic modules 10 to draw off current since the TCO has too much resistance to efficiently perform this function in larger photovoltaic modules. The network 114 shortens the distance charge carriers must move in the TCO layer in order to reach the metal contact, thereby reducing resistive losses. The metal bus bars, also termed grid lines, can be made of any reasonably conductive metal such as, for example, silver, steel or aluminum. The metal bars are preferably configured in a comb-like arrangement to permit light rays through the TCO layer 110. The bus bar network layer 114 and the TCO layer 110, combined, act as a single metallurgical unit, functionally interfacing with a first ohmic contact to form a current collection circuit.

Optional antireflective coating 112 allows a significant amount of extra light into the solar cell 12. Depending on the intended use of the photovoltaic module 10, it might be deposited directly on the top conductor as illustrated in FIG. 1. Alternatively or additionally, the antireflective coating 112 may be deposited on a separate cover glass that overlays the top electrode 110. Ideally, the antireflective coating 112 reduces the reflection of the solar cell 12 to very near zero over the spectral region in which photoelectric absorption occurs, and at the same time increases the reflection in the other spectral regions to reduce heating. U.S. Pat. No. 6,107,564 to Aguilera et al., hereby incorporated by reference herein in its entirety, describes representative antireflective coatings that are known in the art.

Solar cells 12 typically produce only a small voltage. For example, silicon based solar cells produce a voltage of about 0.6 volts (V). Thus, solar cells 12 are interconnected in series or parallel in order to achieve greater voltages. When connected in series, voltages of individual solar cells add together while current remains the same. Thus, solar cells arranged in series reduce the amount of current flow through such cells, compared to analogous solar cells arranged in parallel, thereby improving efficiency. As illustrated in FIG. 1, the arrangement of solar cells 12 in series is accomplished using interconnects 116. In general, an interconnect 116 places the first electrode of one solar cell 12 in electrical communication with the counter-electrode of an adjoining solar cell 12 of a photovoltaic module 10.

Various fabrication techniques (e.g., mechanical and laser scribing) are used to segment a photovoltaic module 10 into individual solar cells 12 to generate high output voltage through integration of such segmented solar cells. Grooves that separate individual solar cells typically have low series resistance and high shunt resistance to facilitate integration. Such grooves are made as small as possible in order to minimize dead area and optimize material usage. Relative to mechanical scribing, laser scribing is more precise and suitable for more types of material. This is because hard or brittle materials often break or shatter during mechanical scribing, making it difficult to create narrow grooves between solar cells.

Despite the advantages of laser scribing, problems are known to occur when scribing photovoltaic modules. For example, one method of scribing a long cylindrical photovoltaic module is to place the module horizontally and rotate it while having a stationary scriber make the cuts. However, in this arrangement the photovoltaic module is only supported at the ends and not in the middle. Gravitational effects create a "bow" effect where the middle portion of the photovoltaic module is slightly bent, creating a shape like a curved rod. This bow may not be significant, but it is enhanced when the photovoltaic module is rotated during scribing. While the photovoltaic module rotates, the bow effect creates a difference in distance between the circumference of the photovoltaic module and the stationary scriber varies as the photovoltaic module is rotating. This results in an uneven cut in the photovoltaic module since the scriber is very sensitive to changes in distance. Scribing some layers of the photovoltaic module requires precision control of the cuts. Uneven cuts could destroy the functionality of the solar cells produced by such scribing. For example, it may be intended to scribe a groove through the entirety of a layer on the photovoltaic module. If the distance between the scribe and the photovoltaic module changes during scribing, portions of the groove may not be deep enough to cut completely through the layer.

Also, the photovoltaic module is normally spun at a high rotational speed for portions of the scribing process. Imperfections in the shape of the photovoltaic module, including the bow effect, create a non-symmetrical moment of inertia as the photovoltaic module rotates. Thus, the photovoltaic module experiences an uneven outward pull due to the centrifugal force. This enhances the undesired shape of the bow, resulting in even larger variances in distance between the cell and the scriber during rotation. For example, a distance change of three millimeters (mm) between the surface of the photovoltaic module and the scriber during rotation could result in fatal defects in the design of the solar cells of the photovoltaic module. Conventional mechanical and laser scribers cannot adjust well to the changes in distance between the scribe and the photovoltaic module. A change in distance results in an uneven force being applied as the photovoltaic module is rotationally scribed, resulting in differences in width and depth of the grooves cut by the scribe.

A mechanical scriber for scribing solar cells is described in U.S. Pat. No. 4,502,255 (hereinafter "Lin"). The downward force of the Lin scriber can be controlled to a precise amount. However, the Lin scriber is designed only to work for planar photovoltaic modules. The Lin scriber cannot readily be used to scribe non-planar photovoltaic modules.

Given the above background, what is needed in the art are systems and methods for scribing any elongated objects, such as non-planar (e.g., cylindrical) photovoltaic modules, that are subject to the bow effect. Such systems and methods can be, for example, used to form solar cells in an elongated photovoltaic module such that a constant force cut is provided regardless of the position of the scriber along a long dimension of the photovoltaic module.

Discussion or citation of a reference herein will not be construed as an admission that such reference is prior art to the present application.

3. SUMMARY

A scribing system comprising a mounting mechanism, stylus, and force generating mechanism is provided. The mounting mechanism is configured to rotate an elongated object in such a manner that the object is subjected to a bow effect wherein a middle portion of the object bends (bows) relative to the end portions of the object. The stylus is for scribing the object at a position x along the long dimension of the object while the mounting mechanism rotates the object. The force generating mechanism is connected to the stylus so that the stylus applies the same constant force to the elongated object regardless of the position x along the long dimension of the object that the stylus is positioned, while the mounting mechanism rotates the object and thereby subjects the object to the bow effect, thereby scribing the object.

4. BRIEF DESCRIPTION OF THE DRAWINGS

Like reference numerals refer to corresponding parts throughout the several views of the drawings. Dimensions are not drawn to scale.

5. DETAILED DESCRIPTION

Disclosed herein are systems and methods directed towards constant force mechanical scribers. Such systems and methods can be used for a wide range of applications such as for manufacturing photovoltaic modules. More generally, such scribers can be used to facilitate a broad array of micromachining techniques including microchip fabrication. Micromachining (also termed microfabrication, micromanufacturing, micro electromechanical systems) refers to the fabrication of devices with at least some of their dimensions in the micrometer range. See, for example, Madou, 2002, *Fundamentals of Microfabrication*, Second Edition, CRC Press LLC, Boca Raton, Fla., which is hereby incorporated by reference herein in its entirety for its teachings on microfabrication. Microchip fabrication is disclosed in Van Zant, 2000, *Microchip Fabrication*, Fourth Edition, McGraw-Hill, New York.

5.1 Constant Force Mechanical Scribers

In accordance with an aspect of the present application, systems and methods for mechanical scribing are disclosed that overcome non-symmetry effects that occur during the scribing of elongated objects such as photovoltaic modules. In some embodiments, the systems and methods for scribing can be used in the fabrication of solar cells in such elongated photovoltaic modules. One of the many purposes of scribing a photovoltaic module is to break the module up into discrete solar cells that may then be electrically combined in a serial or parallel manner in a process known as monolithic integration. Such monolithically integrated solar cells are described, for example, in U.S. Pat. No. 7,235,736, which is hereby incorporated by reference herein in its entirety for such purpose. Such monolithic integration has the advantage of reducing current carrying requirements of the photovoltaic module. Sufficient monolithic integration, therefore, substantially reduces electrode, transparent conductor, and counter-electrode current carrying requirements, thereby minimizing material costs. The present application provides improved methods for forming the necessary grooves needed to form electrically connected solar cells in a photovoltaic module. More details of such photovoltaic modules are disclosed in Section 5.2, below, as well as U.S. Pat. No. 7,235,736.

Figure 3A:
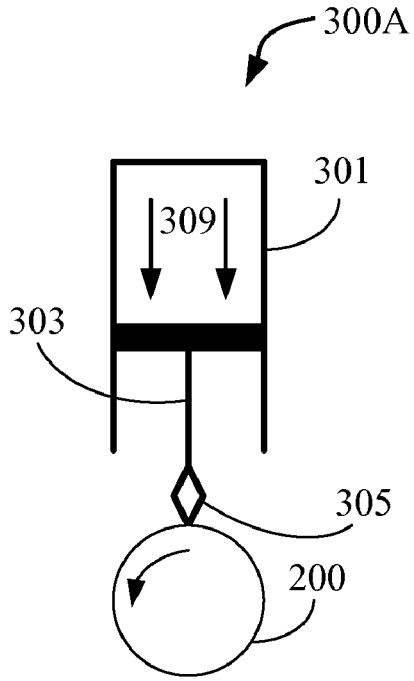
FIGS. 3A-3D illustrate embodiments of constant force mechanical scribers in accordance with embodiments of the present disclosure.

FIGS. 3A through 3D illustrate different embodiments of a constant force mechanical scriber (CFMS). The CFMSs disclosed herein are not limited to those illustrated in the figures. Variations and modifications of the CFMS embodiments presented are contemplated herein. FIG. 3A shows a CFMS 300A comprising an air cylinder 301, a piston 303 connected to a stylus 305. Stylus 305 scribes an elongated object such as a photovoltaic module 200. For ease of understanding aspects of the disclosure, the elongated object will be referred to as a photovoltaic module. However, it will be understood that in any instance where an elongated photovoltaic module is referenced, the object could in fact be any elongated object that exhibits a "bow" effect when being scribed where the middle portion of the object is bent relative to the ends of the object, creating a shape like a curved rod.

The elongated photovoltaic module, or other elongated object, is held by a mounting mechanism that is configured to hold the elongated photovoltaic module such that the elongated photovoltaic module can be rotated. One example of such a mounting mechanism is a lathe. Lathes are well know machine shop tools that are described in, for example, Edwards, *Lathe Operation and Maintenance,* 2003, Hanser Garner Publications, Cincinnati, Ohio, which is hereby incorporated by reference for its disclosure on lathes.

Returning to FIG. 3A, an embodiment of the present disclosure provides a constant force mechanical scriber comprising (i) an air cylinder 301, a stylus 305, a piston 303 having a head end (e.g., wide, flat portion) and a tail end, where the head end of the piston 303 is inside the air cylinder 301 and the tail end of the piston 303 is connected to the stylus 305, and a control system (not shown), where the control system is configured to control an air pressure inside the air cylinder 301 and is configured to thereby apply a constant air pressure to the head end of the piston 303 thereby allowing the stylus 305 to apply a constant force to the elongated object in order to scribe the elongated object. As illustrated, the elongated photovoltaic module 200 is rotating in a counter-clockwise direction. However, the photovoltaic module 200 is not limited to rotating in such a direction. For instance, the elongated photovoltaic module 200 could rotate in a clockwise direction. There exists air pressure 309 inside the air cylinder 301 that presses down on the head end of the piston 303. This air pressure 309 translates into a force that stylus 305 exerts onto the surface of the elongated photovoltaic module 200, which allows the stylus to cut grooves in a layer of the elongated photovoltaic module. The force exerted by stylus 305 is kept constant if the air pressure 309 is kept constant. The air pressure in air cylinder 301 can be monitored and controlled, for example, by using a computer control system. When the elongated photovoltaic module 200 moves away from the stylus 305, the piston 303 moves toward the elongated photovoltaic module 200 because the air pressure 309 exerted on piston 303 pushes toward the elongated photovoltaic module 200. Conversely, when the elongated photovoltaic module 200 moves toward the stylus 305, the piston 303 pushes back into the air cylinder 301, but the constant air pressure 309 means that a constant force is still applied to the elongated photovoltaic module 200. Through this system, the CFMS can apply a constant force while scribing regardless of the displacement y of a middle portion of the elongated photovoltaic module 200 illustrated in FIG. 5A.

Figure 3B:
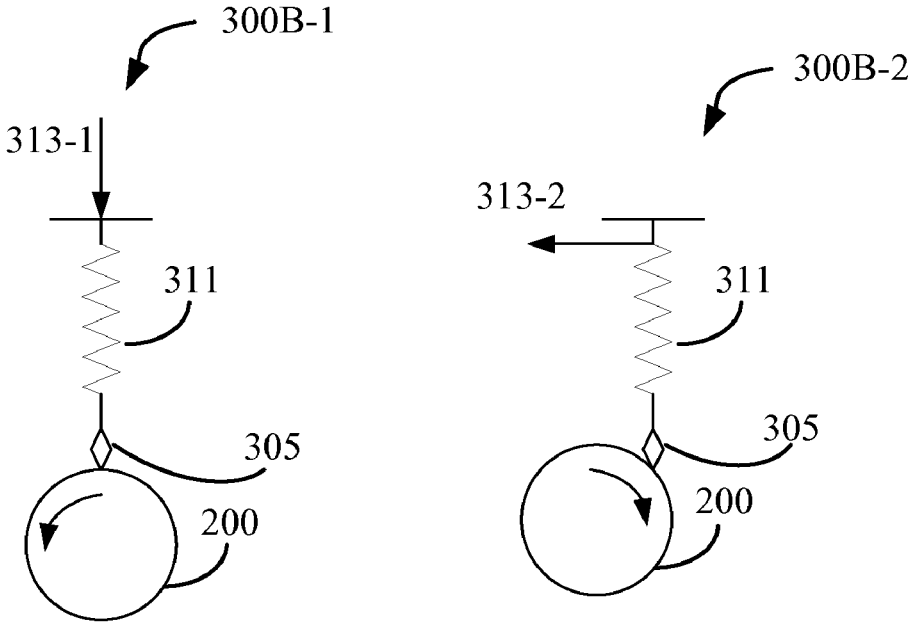
Figure 5A:
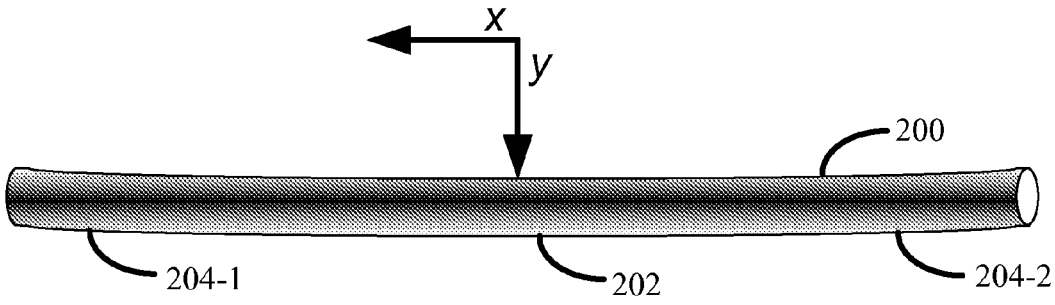
FIGS. 5A-5C illustrate an elongated object having a long dimension that is induced to have a bow effect in which a middle portion of the elongated object bends relative to a first and a second end portion of the elongated object in accordance with embodiments of the present disclosure.
Figure 5B:
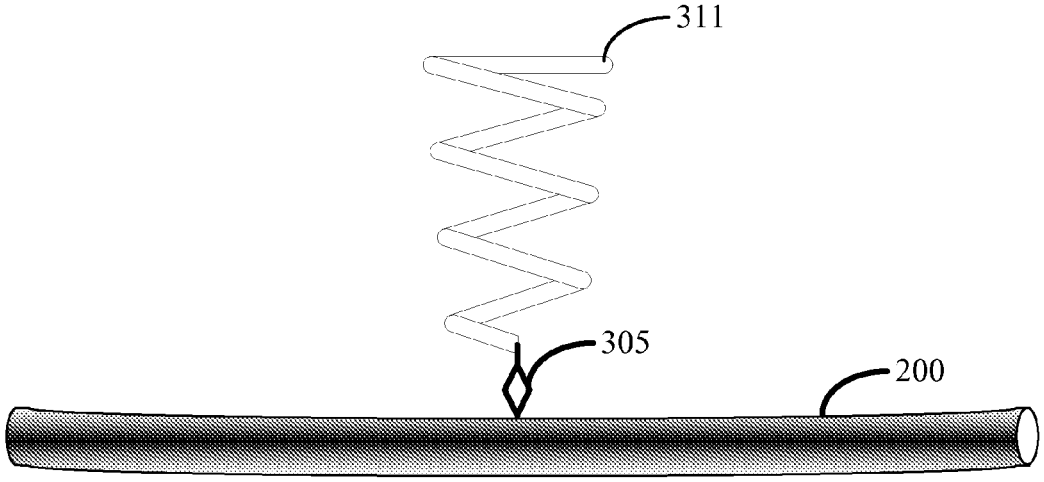

FIG. 3B shows two embodiments of a spring-based CFMS. CFMS 300B-1 illustrates a push-spring configuration, while 300B-2 illustrates a pull-string configuration. In both configurations, a constant force mechanical scriber is provided that comprises a stylus 305, a spring 311 connected to the stylus 305, and a control system (not shown). The control system is configured to apply a constant force 313 to the spring 311 thereby allowing the stylus 305 to apply a constant force to an elongated object (e.g., photovoltaic module 200) in order to scribe the elongated object regardless of which a position x along a long dimension of the elongated object that the stylus engages the elongated object. The constant force mechanical scriber is configured to induce elongated object to a bow effect whereby a middle portion of the elongated object bows (e.g., by a displacement y as illustrated in FIG. 5A) relative to the a first and a second end portions of the elongated object while being scribed. As illustrated in FIG. 3B, stylus 305 is used to cut grooves in a layer of the elongated photovoltaic module 200. In the push-spring configuration, a force 313-1 parallel to the length of the spring 311 pushes the spring, which in turn pushes the stylus onto the elongated photovoltaic module 200. In the pull-spring configuration, force 313-2 perpendicular to the length of the spring 311 pulls the spring 311 onto the elongated photovoltaic module 200 against the direction of rotation of elongated photovoltaic module 200, thus dragging the stylus 305 around the surface of the elongated photovoltaic module. If forces 313-1 or 313-2 remain constant, then the stylus 305 applies a constant force to the elongated photovoltaic module during scribing. The elongated photovoltaic modules illustrated in FIG. 3B are respectively shown as spinning in the counter-clockwise direction (300B-1) and the clockwise direction (300B-2) but the combination of CFMS and rotation direction is not limited to the configurations illustrated. FIG. 5B illustrates a perspective view of a spring 311 connected to a stylus 305 for scribing an elongated object, such as an elongated photovoltaic module 200.

A spring with spring constant k will require a force F to change its length by a distance Δy. The equation relating these three variables is Hooke's law:

$$F=-k\Delta y$$

As illustrated in FIG. 5A, the bow effect of the elongated photovoltaic module 200, the tendency of middle region 202 of the elongated photovoltaic module 200 to be displaced by a distance y relative to first and second end portion 204 of the elongated photovoltaic module, during rotation of the elongated object will vary the distance between the stylus and the elongated photovoltaic module as a function of the position along the length x of the elongated photovoltaic module 200. This variance in distance between the stylus 305 and the surface of the elongated photovoltaic module is expressed by the equation Δy. The bow effect causes a variance in distance y along the length x of the elongated photovoltaic module (where length x is normal to the view of the elongated photovoltaic module given in FIGS. 3A through 3D) that is small in relation to the spring constant, and so the force exerted by the spring is roughly constant despite the bow effect. The spring essentially "absorbs" the change in distance without a requisite change in force. For example, if the bow effect causes a displacement of 3 mm (Δy=3 mm), then the force F exerted by spring 311 on the elongated photovoltaic module (force 313-1 or 313-2) is essentially unchanged (theoretically, F does change but it is negligible for such short distances). Thus the CFMS can exert a constant force on the elongated photovoltaic module even if the distance between the CFMS and the elongated photovoltaic module 200 varies.

Figure 3C:
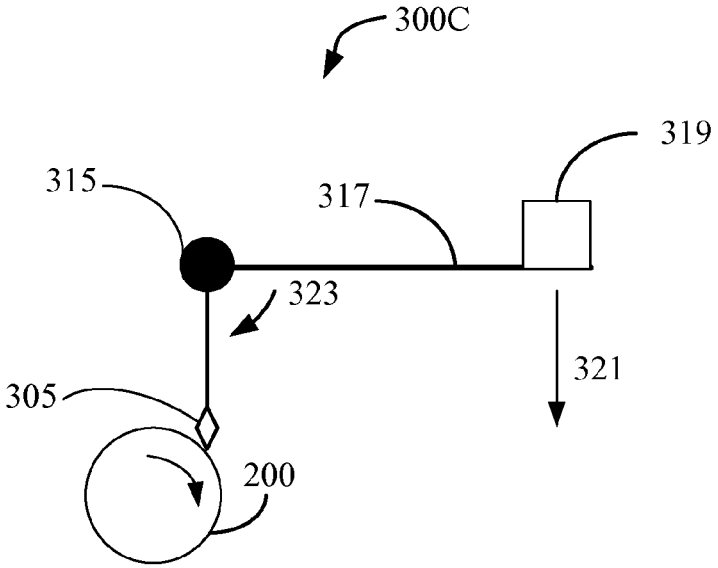
Figure 5C:
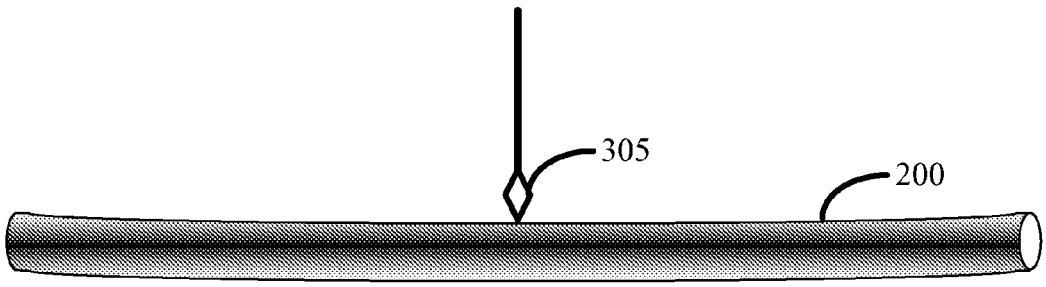

FIG. 3C shows an embodiment of a pendulum-based CFMS. The constant force mechanical scriber comprises a stylus 305, a pivot point 315 connected to the stylus 305, and a pendulum 317 having a first end and a second end. The first end of the pendulum is connected to the pivot point 315 at a point perpendicular to a long axis of the stylus 305 and the second end of the pendulum comprises a weight 319. A gravitational force of the weight 319 allows the stylus 305 to apply the same constant force to an elongated object (e.g., elongated photovoltaic module 200) while the stylus scribes the elongated object regardless of which position x along a long dimension of the elongated object that the stylus engages the elongated object. Referring to FIGS. 3C and 5A, the constant force mechanical scriber is configured to subject the elongated object to a bow effect whereby a middle portion 202 of the elongated object is displaced by a distance y relative to first and second end portions 204 of the elongated object while being scribed by the stylus. In some embodiments, stylus 305 and pendulum 317 are perpendicular to each other and the pendulum is oriented horizontally. In FIG. 3C, the elongated photovoltaic module 200 is depicted as rotating in a counter-clockwise direction but there is no requirement that the elongated photovoltaic module rotate in that direction. In other embodiments, the elongated photovoltaic module rotates in a clockwise direction. At the other end of pendulum 317 is a weight 319, which exerts a downward gravitational force 321. The gravitational force 321 is constant, and thus provides a constant torque 323 on pivot point 315. The torque creates a constant force that stylus 305 exerts on the elongated photovoltaic module 200. This force does not change even if the distance between the stylus and the elongated photovoltaic module 200 changes. This is because pivot point 315 automatically adjusts for changes in the distance between the stylus 305 and the elongated photovoltaic module 200 by rotating either clockwise (when the photovoltaic module 200 moves closer to the stylus 305 in FIG. 3C) or counter-clockwise (when the elongated photovoltaic module 200 moves away from the stylus 305 in FIG. 3C). The specific configuration of CFMS 300C will determine which way the pivot point rotates in order to maintain a constant force. FIG. 5C illustrates a perspective view of a stylus 305 for scribing an elongated object, such as an elongated photovoltaic module 200.

Figure 3D:
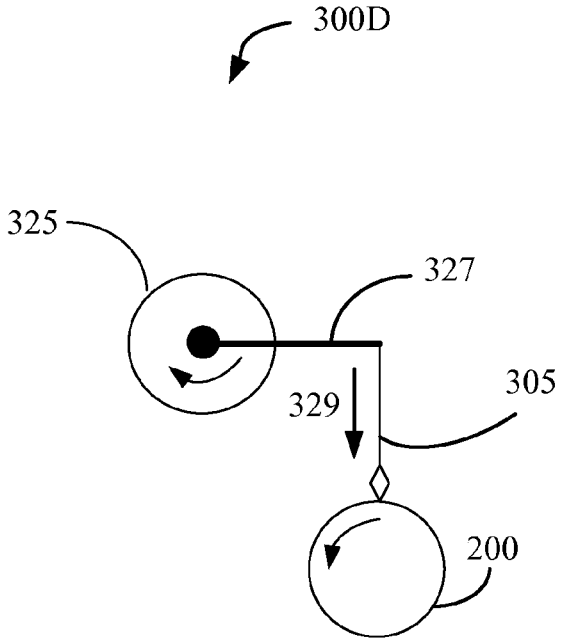

FIG. 3D shows an embodiment of a motor-based CFMS. The constant force mechanical scriber comprises a stylus 305, a motor 325 having a drive shaft; and a rod 327 having a first end and a second end. The first end of the rod 327 is connected to the drive shaft and the second end of the rod is connected to the stylus 305. The motor 325 is configured to produce a constant torque that allows the stylus 305 to apply a constant force to an elongated object (e.g., the elongated photovoltaic module 200) in order to scribe the elongated object regardless of which position x along a long dimension of the elongated object that the stylus 305 engages the elongated object. Referring to FIGS. 3D and 5A, the constant force mechanical scriber is configured to subject the elongated object is subject to a bow effect whereby a middle portion 202 of the elongated object bows (e.g., is displaced by a distance y) relative to a first and a second end portion 204 of the elongated object while being scribed by the stylus 305. As illustrated in FIG. 3D, the rod 327 is connected to the drive shaft of the motor 325 (facing out of the page as illustrated in FIG. 3D). The other end of the rod 327 is connected to the stylus 305. When a current is applied to the motor 325 it rotates the drive shaft. In FIG. 3D, the drive shaft is illustrated as turning in a clockwise direction but is not limited to that direction. This rotation also forces the rod 327 and the stylus 305 to swing around in a clockwise direction. In some embodiments, a brace (not shown) is used to limit the rotational motion of the rod. When the elongated photovoltaic module 200 is in contact with the stylus 305 as shown, the rotational motion of the motor causes a downward force 329 by the stylus onto the elongated photovoltaic module 200. If the torque produced by the motor 325 is constant, then the force 329 that is exerted on the photovoltaic module 200 is also constant, regardless of the distance between the stylus 305 and the elongated photovoltaic module 200. If the distance changes, then the stylus 305 moves toward the elongated photovoltaic module 200 (if the elongated photovoltaic module moves away from the stylus) or is pushed upward by the elongated photovoltaic module if it moves toward the stylus. Thus the motor is able to provide a constant force while rotationally scribing the elongated photovoltaic module.

Figure 2A:
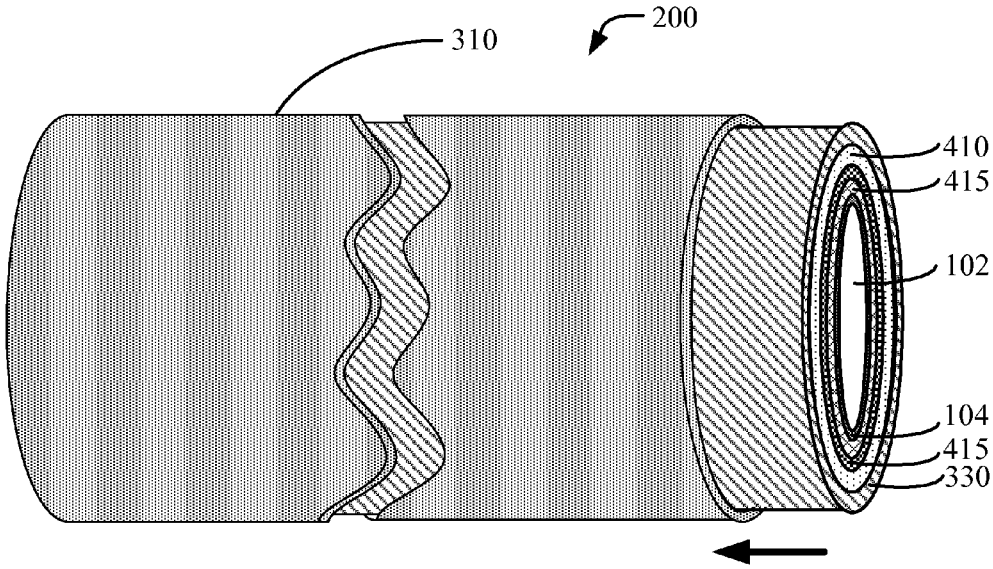
FIG. 2A illustrates a non-planar photovoltaic module in accordance with the present disclosure.
Figure 2B:
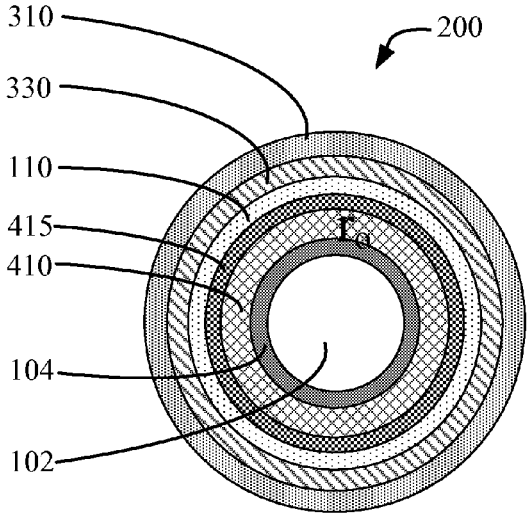
FIG. 2B illustrates a cross-sectional view of a non-planar photovoltaic module in accordance with embodiments of the present disclosure.
Figure 2C:
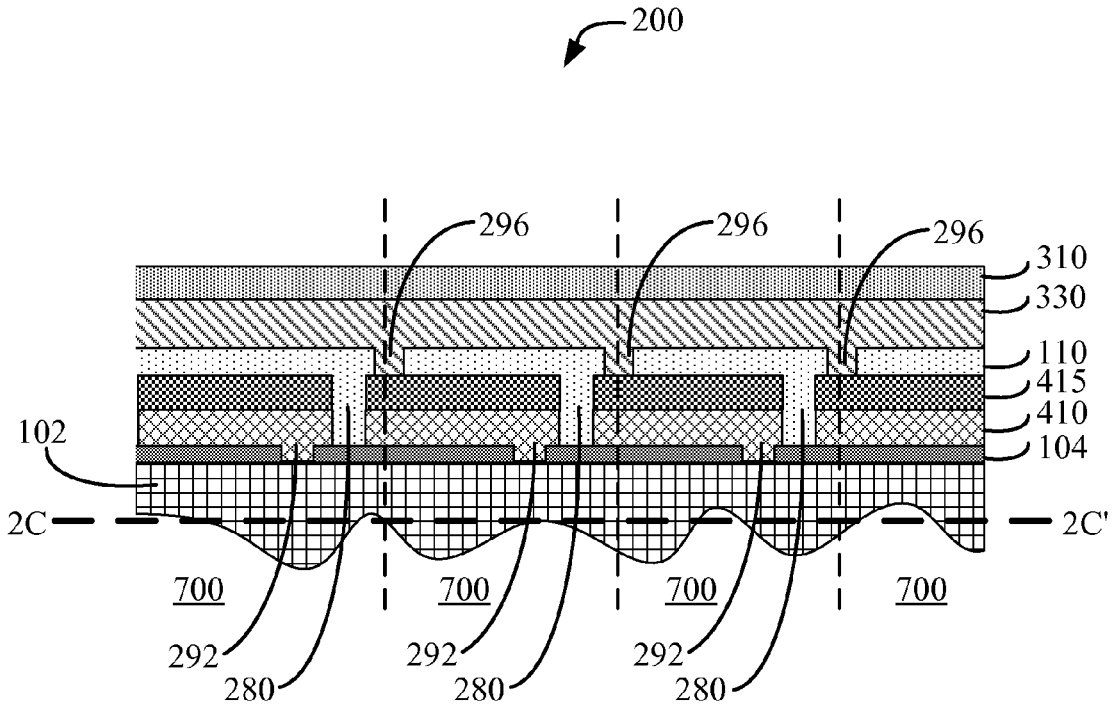
FIG. 2C illustrates a cross-sectional view of a non-planar photovoltaic module in accordance with the present disclosure.

In some embodiments, the amount of force that the CFMS applies to the photovoltaic module 200 during scribing is between about 10 grams (g) and about 300 g. In some embodiments, the force the CFMS applies to the elongated photovoltaic module 200 while scribing grooves 280 is about 80 g. In some embodiments, the force the CFMS applies to the elongated photovoltaic module while scribing grooves 296 is about 150 g. Referring to FIG. 5A, in some embodiments, the maximum displacement y by the middle portion 202 of the photovoltaic module 200 relative to end portions 204 during rotational scribing is about, ±1000 mm, ±100 mm, ±50 mm, ±25 mm, ±10 mm, ±9 mm, ±8 mm, ±7 mm, ±6 mm, ±5 mm, ±4 mm, ±3 mm, ±2 mm, ±1 mm, ±0.5 mm, ±0.1 mm, ±0.01 mm, or ±0.001 mm. In some embodiments, the length x of elongated photovoltaic module 200 is greater than 10 cm, greater than 15 cm, greater than 25 cm, greater than 50 cm, greater than 75 cm, greater than 100 cm, greater than 125 cm, greater than 150 cm, greater than 175 cm, greater than 200 cm, greater than 225 cm, greater than 250 cm, greater than 275 cm, greater than 300 cm, greater than 325 cm, or greater than 350 cm. In some embodiments, the maximum displacement y by the middle portion 202 of the photovoltaic module 200 relative to end portions 204 during rotational scribing is about ±0.001% of the length x of the photovoltaic module 200, ±0.01% of the length x of the photovoltaic module 200, ±0.1% of the length x of the photovoltaic module 200, ±0.15% of the length x of the photovoltaic module 200, ±0.2% of the length x of the photovoltaic module 200, ±0.25% of the length x of the photovoltaic module 200, ±0.3% of the length x of the photovoltaic module 200, ±0.35% of the length x of the photovoltaic module 200, ±0.4% of the length x of the photovoltaic module 200, ±0.5% of the length x of the photovoltaic module 200, ±1% of the length x of the photovoltaic module 200, ±2% of the length x of the photovoltaic module 200, ±5% of the length x of the photovoltaic module 200, or ±10% of the length x of the photovoltaic module 200. In some embodiments, the thickness of layers 104, 410, and 110 in FIGS. 2A through 2C is between about 0.1 microns and about 10 microns.

In some embodiments, the grooves 292 have an average width from about 10 microns to about 150 microns. In some embodiments, grooves 292 have an average width of about 90 microns. In some embodiments, grooves 280 have an average width of about 80 microns. In some embodiments, grooves 280 have an average width from about 50 microns to about 150 microns. In some embodiments, grooves 280 have an average width of about 150 microns. In some embodiments, grooves 296 have an average width from 50 microns to about 300 microns.

In some embodiments, the elongated photovoltaic module 200 is rotated at a speed of between about 100 revolutions per minute (RPM) and 1000 RPM (e.g., about 500 RPM) while scribing the grooves 280. In some embodiments, the elongated photovoltaic module 200 is rotated at a speed of between about 50 RPM and about 3000 RPM while scribing the grooves 280. In some embodiments, the grooves 280 have an average width of about 80 microns. In some embodiments, the grooves 280 have an average width between about 50 microns and about 150 microns.

In some embodiments, the elongated photovoltaic module 200 is rotated at a speed of between about 100 RPM and about 1000 RPM (e.g., about 500 RPM) while scribing the grooves 296. In some embodiments, the elongated photovoltaic module 200 is rotated at a speed between about 50 RPM and about 3000 RPM while scribing the grooves 296. In some embodiments, the grooves 296 have an average width of about 150 microns. In some embodiments, the grooves 296 have an average width of about 50 microns to about 300 microns.

In some embodiments, the stylus 305 in FIGS. 3A through 3D is a carbide tip, a diamond coated tip, a stainless steel tip, or a tin nitride coated carbide tip. Styluses for use in mechanical scribing are known in the art and are contemplated in the present invention.

An aspect of the present invention comprises systems and methods for providing a mechanical scribe that can cut a groove in an elongated photovoltaic module by applying a constant force while scribing. Applying a constant force while scribing allows the resulting grooves to be more uniform and electrically insulating than would otherwise be found if a variable force scribe was used. In some embodiments, a groove is electrically isolating when the resistance across the groove (e.g., from a first side of the groove to a second side of the groove) is 10 ohms or more, 20 ohms or more, 50 ohms or more, 1000 ohms or more, 10,000 ohms or more, 100,000 ohms or more, $1\times10^6$ ohms or more, $1\times10^7$ ohms or more, $1\times10^8$ ohms or more, $1\times10^9$ ohms or more, or $1\times10^{10}$ ohms or more. Referring to FIG. 2C, a groove 292 may be formed by scribing a common back-electrode 104, a groove 280 may be formed by scribing a common semiconductor junction 410, and a groove 296 may be formed by scribing a common transparent conductor 110. In some embodiments disclosed herein, the grooves 292 are defined as any and all cuts in back-electrode 104, the grooves 294 are defined as any and all cuts in the semiconductor junction 410, and the grooves 296 are defined as any and all cuts in the transparent conductor 110.

Figure 1A:
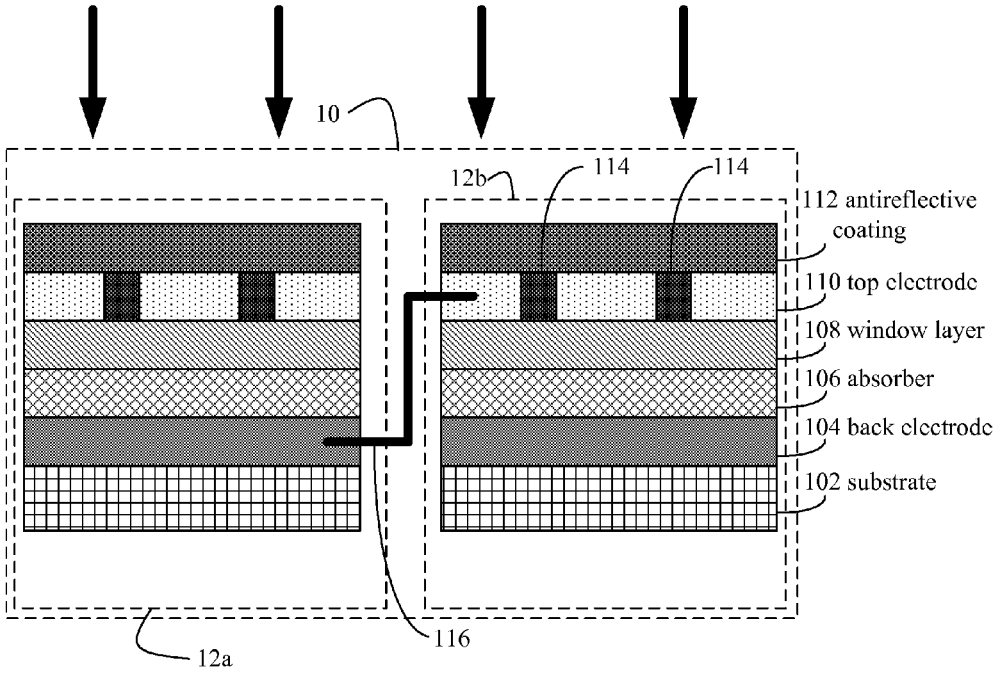
Fig. 1A (Prior Art)
FIG. 1 illustrates interconnected solar cells of a photovoltaic module in accordance with the prior art.

Referring to FIG. 2C, because grooves 292 and 296 are created in conductive material (top and back-electrodes), the grooves fully extend through the respective back-electrode 104 and transparent conductor 110 to ensure that the grooves are electrically isolating. For example, for a planar photovoltaic module (depicted as module 100 in FIG. 1A), electrically isolating grooves 292 and 296 traverse an entire length or width of a selected layer. For non-planar photovoltaic modules (depicted as elongated photovoltaic module 200 in FIG. 2A), grooves 292 and 296 are respectively scribed around the entire circumference of back-electrode 104 and transparent conductor 110. The groove 280 (also referred to as via 280 once the groove is filled with the end-point material) differs from grooves 292 and 296 in the sense that the groove, once filled with material, does conduct current. The groove 280 is created to connect a back-electrode 104 with the transparent conductor 110, so that current flows through via 280 (formed by groove 280 once it is filled) from a back-electrode 104 and a transparent conductor 110. Nevertheless, there is still little or no current flowing from one side of a via 280 to the other side of the same via 280.

Referring to FIG. 2C, the elongated photovoltaic module 200 comprises a substrate 102 common to a plurality of solar cells 700 linearly arranged on the substrate 102. Each solar cell 700 in the plurality of solar cells 700 comprises a back-electrode 104 circumferentially disposed on common substrate 102 and a semiconductor junction 410 circumferentially disposed on the back-electrode 104. Each solar cell 700 in the plurality of solar cells 700 further comprises a transparent conductor 110 circumferentially disposed on the semiconductor junction 410. In the case of FIG. 2C, the transparent conductor 110 of the first solar cell 700 is in serial electrical communication with the back-electrode of the second solar cell 700 in the plurality of solar cells because of vias 280. In some embodiments, each via 280 extends the full circumference of the elongated photovoltaic module and/or solar cell of the elongated photovoltaic module. In some embodiments, each via 280 does not extend the full circumference of the elongated photovoltaic module and/or solar cell of the elongated photovoltaic module. In fact, in some embodiments, each via 280 only extends a small percentage of the circumference of the elongated photovoltaic module and/or solar cell of the elongated photovoltaic module. In some embodiments, each solar cell 700 may have one, two, three, four or more, ten or more, or one hundred or more vias 280 that electrically connect in series the transparent conductor 110 of the solar cell 700 with back-electrode 104 of an adjacent solar cell 700.

Methods and systems for creating grooves 292, 280, and 296 are disclosed. In an aspect of the present invention, a constant force mechanical scriber (CFMS) is used to cut at least one of the grooves 292, 280, and 296. A CFMS has the ability to provide a constant force against an object it is scribing, even if the distance between the scribe and the object changes during scribing. The result is a more even and uniform cut, which may be important for certain scribing applications. For example, grooves 280 and 296 may have small tolerances in terms of allowable deviations from the ideal depth, width, and cleanness of the groove. A conventional scribe may not be able to cut a groove that is within such tolerances due to the non-symmetry of the elongated photovoltaic module during rotational scribing. Thus a CFMS is used to cut grooves that satisfy those tolerances. In some embodiments, the dimensional tolerances for groove 292 are less restrictive and so a CFMS is not necessary for cutting grooves 292. Systems and methods for scribing a photovoltaic module are provided in U.S. patent application Ser. No. 12/202,295, filed Sep. 31, 2008, which is hereby incorporated by reference herein in its entirety.

In some embodiments, the term "about" as used herein means within ±5% of the stated value. In other embodiments, the term "about" as used herein means within ±10% of the stated value. In yet other embodiments, the term "about" as used herein means within ±20% of the stated value. In some embodiments, the term "constant force" as used herein means within ±5% of the stated or ideal force value. In other embodiments, the term "constant force" means within ±2% of the stated or ideal force value. In yet other embodiments, the term "constant force" means within ±1% of the stated or ideal force value.

5.2 Overview of Elongated Photovoltaic Modules that can be Scribed

Disclosed herein are systems and methods for scribing solar cells in elongated photovoltaic modules. In typical embodiments, such solar cells have components and layers described in this section.

Elongated substrate 102. Referring, for example, to FIG. 2A, an elongated substrate 102 serves as a substrate for one or more solar cells of an elongated photovoltaic module 200. In some embodiments, the elongated substrate 102 is made of a plastic, metal, metal alloy, or glass. In some embodiments, the elongated substrate 102 is cylindrical in shape. Such cylindrical shapes can be solid (e.g., a rod) or hollowed (e.g., a tube). As used here, the term tubular means objects having a tubular or approximately tubular shape. In fact, tubular objects can have irregular shapes so long as the object, taken as a whole, is roughly tubular. In some embodiments, the elongated substrate 102 supports one or more solar cells 12 arranged in a bifacial, multi-facial, or omnifacial manner. In some embodiments, the elongated substrate 102 is optically transparent to wavelengths that are generally absorbed by the semiconductor junction of a solar cell of a elongated photovoltaic module 200. In some embodiments, the elongated substrate 102 is not optically transparent. Further embodiments of the elongated substrate 102 are discussed in Section 5.3.

Back-electrode 104. A back-electrode 104 is disposed on the substrate 102. The back-electrode 104 serves as the first electrode in the assembly. In general, the back-electrode 104 is made out of any material such that it can support the photovoltaic current generated by the elongated photovoltaic module 200 with negligible resistive losses. In some embodiments, the back-electrode 104 is composed of any conductive material, such as aluminum, molybdenum, tungsten, vanadium, rhodium, niobium, chromium, tantalum, titanium, steel, nickel, platinum, silver, gold, an alloy thereof (e.g. KOVAR), or any combination thereof. In some embodiments, the back-electrode 104 is composed of any conductive material, such as indium tin oxide, titanium nitride, tin oxide, fluorine doped tin oxide, doped zinc oxide, aluminum doped zinc oxide, gallium doped zinc oxide, boron dope zinc oxide indium-zinc oxide, a metal-carbon black-filled oxide, a graphite-carbon black-filled oxide, a carbon black-carbon black-filled oxide, a superconductive carbon black-filled oxide, an epoxy, a conductive glass, or a conductive plastic. A conductive plastic is one that, through compounding techniques, contains conductive fillers which, in turn, impart their conductive properties to the plastic. In some embodiments, the conductive plastics used in the present application to form the back-electrode 104 contain fillers that form sufficient conductive current-carrying paths through the plastic matrix to support the photovoltaic current generated by the elongated photovoltaic module 200 with negligible resistive losses. The plastic matrix of the conductive plastic is typically insulating, but the composite produced exhibits the conductive properties of the filler. In one embodiment, the back-electrode 104 is made of molybdenum.

Semiconductor junction 410. A semiconductor junction 410 is formed on the back-electrode 104. In some embodiments, the semiconductor junction 410 is circumferentially disposed on the back-electrode 104. In some embodiments semiconductor junction 410 is a photovoltaic homojunction. In some embodiments semiconductor junction 410 is a photovoltaic heterojunction. In some embodiments semiconductor junction 410 is a photovoltaic heteroface junction. In some embodiments semiconductor junction 410 is a buried homojunction, p-i-n junction. In some embodiments semiconductor junction 410 is a tandem junction having an absorber layer that is a direct band-gap absorber (e.g., crystalline silicon). In some embodiments semiconductor junction 410 is a tandem junction having an absorber layer that is an indirect band-gap absorber (e.g., amorphous silicon). Such junctions are described in Chapter 1 of Bube, *Photovoltaic Materials,* 1998, Imperial College Press, London, as well as Lugue and Hegedus, 2003, *Handbook of Photovoltaic Science and Engineering*, John Wiley & Sons, Ltd., West Sussex, England, each of which is hereby incorporated by reference herein in its entirety. Details of exemplary types of semiconductors junctions 410 in accordance with the present application are disclosed in Section 5.4, below. In addition to the exemplary junctions disclosed in Section 5.4, below, the junctions 410 can be multi junctions in which light traverses into the core of junction 410 through multiple junctions that, preferably, have successfully smaller band gaps. In some embodiments, the semiconductor junction 410 includes a copper-indium-gallium-diselenide (CIGS) absorber layer. Optional intrinsic layer 415. Optionally, there is a thin intrinsic layer (i-layer) 415 disposed on the semiconductor junction 410. In some embodiments, the i-layer 415 is circumferentially disposed on the semiconductor junction 410. The i-layer 415 can be formed using, for example, any undoped transparent oxide including, but not limited to, zinc oxide, metal oxide, or any transparent material that is highly insulating. In some embodiments, i-layer 415 is highly pure zinc oxide.

Transparent conductor 110. In some embodiments, transparent conductor 110 is disposed on the semiconductor junction layer 410 thereby completing the circuit. In some embodiments where the substrate 102 is cylindrical or tubular, a transparent conductor is circumferentially disposed on an underlying layer. As noted above, in some embodiments, a thin i-layer 415 is disposed on the semiconductor junction 410. In such embodiments, the transparent conductor 110 is disposed on the i-layer 415.

In some embodiments, the transparent conductor 110 is made of tin oxide $SnO_x$ (with or without fluorine doping), indium-tin oxide (ITO), doped zinc oxide (e.g., aluminum doped zinc oxide, gallium doped zinc oxide, boron dope zinc oxide), indium-zinc oxide or any combination thereof. In some embodiments, the transparent conductor 110 is either p-doped or n-doped. For example, in embodiments where the outer layer of the junction 410 is p-doped, the transparent conductor 110 can be p-doped. Likewise, in embodiments where the outer layer of the junction 410 is n-doped, the transparent conductor 110 can be n-doped. In general, the transparent conductor 110 is preferably made of a material that has very low resistance, suitable optical transmission properties (e.g., greater than 90%), and a deposition temperature that will not damage underlying layers of the semiconductor junction 410 and/or the optional i-layer 415.

In some embodiments, the transparent conductor is made of carbon nanotubes. Carbon nanotubes are commercially available, for example from Eikos (Franklin, Mass.) and are described in U.S. Pat. No. 6,988,925, which is hereby incorporated by reference herein in its entirety. In some embodiments, the transparent conductor 110 is an electrically conductive polymer material such as a conductive polytiophene, a conductive polyaniline, a conductive polypyrrole, a PSS-doped PEDOT (e.g., BAYRTON), or a derivative of any of the foregoing.

In some embodiments, the transparent conductor 110 comprises more than one layer, including a first layer comprising tin oxide $SnO_x$ (with or without fluorine doping), indium-tin oxide (ITO), indium-zinc oxide, doped zinc oxide (e.g., aluminum doped zinc oxide, gallium doped zinc oxide, boron dope zinc oxide) or a combination thereof and a second layer comprising a conductive polytiophene, a conductive polyaniline, a conductive polypyrrole, a PSS-doped PEDOT (e.g., BAYRTON), or a derivative of any of the foregoing. Additional suitable materials that can be used to form the transparent conductor are disclosed in United States Patent publication 2004/0187917A1 to Pichler, which is hereby incorporated by reference herein in its entirety.

Optional filler layer 330. In some embodiments, as depicted for example in FIG. 2B, a filler layer 330 is circumferentially disposed on the transparent conductor 110. The filler layer 330 can be used to protect the photovoltaic module from physical or other damage, and can also be used to aid the photovoltaic module in collecting more light by its optical and chemical properties. Embodiments of the optional filler layer 330 are discussed in Section 5.5.

The optional transparent casing 310. The optional transparent casing 310 serves to protect a photovoltaic module 10 from the environment. In embodiments in which the substrate 102 is cylindrical or tubular, the transparent casing 310 is optionally circumferentially disposed on the outermost layer of the photovoltaic module and/or the solar cells of the photovoltaic module (e.g., transparent conductor 110 and/or optional filler layer 330). In some embodiments, the transparent casing 310 is made of plastic or glass. Methods, such as heat shrinking, injection molding, or vacuum loading, can be used to construct transparent tubular casing 310 such that oxygen and water is excluded from the system.

In some embodiments, the transparent casing 310 is made of a urethane polymer, an acrylic polymer, polymethylmethacrylate (PMMA), a fluoropolymer, silicone, poly-dimethyl siloxane (PDMS), silicone gel, epoxy, ethylene vinyl acetate (EVA), perfluoroalkoxy fluorocarbon (PFA), nylon/polyamide, cross-linked polyethylene (PEX), polyolefin, polypropylene (PP), polyethylene terephtalate glycol (PETG), polytetrafluoroethylene (PTFE), thermoplastic copolymer (for example, ETFE®, which is a derived from the polymerization of ethylene and tetrafluoroethylene: TEFLON® monomers), polyurethane/urethane, polyvinyl chloride (PVC), polyvinylidene fluoride (PVDF), TYGON®, vinyl, VITON®, or any combination or variation thereof.

In some embodiments, the transparent casing 310 comprises a plurality of casing layers. In some embodiments, each casing layer is composed of a different material. For example, in some embodiments, the transparent casing 310 comprises a first transparent casing layer and a second transparent casing layer. Depending on the exact configuration of the photovoltaic module, the first transparent casing layer is disposed on the transparent conductor 110, optional filler layer 330 or a water resistant layer. The second transparent casing layer is disposed on the first transparent casing layer.

In some embodiments, each transparent casing layer has different properties. In one example, the outer transparent casing layer has excellent UV shielding properties whereas the inner transparent casing layer has good water proofing characteristics. Moreover, the use of multiple transparent casing layers can be used to reduce costs and/or improve the overall properties of the transparent casing 310. For example, one transparent casing layer may be made of an expensive material that has a desired physical property. By using one or more additional transparent casing layers, the thickness of the expensive transparent casing layer may be reduced, thereby achieving a savings in material costs. In another example, one transparent casing layer may have excellent optical properties (e.g., index of refraction, etc.) but be very heavy. By using one or more additional transparent casing layers, the thickness of the heavy transparent casing layer may be reduced, thereby reducing the overall weight of transparent casing 310. In some embodiments, only one end of the photovoltaic module is exposed by transparent casing 310 in order to form an electrical connection with adjacent solar cells or other circuitry. In some embodiments, both ends of the elongated photovoltaic module are exposed by transparent casing 310 in order to form an electrical connection with adjacent solar cells 12 or other circuitry. More discussion of transparent casings 310 that can be used in some embodiments of the present application is disclosed in U.S. patent application Ser. No. 11/378,847, which is hereby incorporated by reference herein in its entirety. Additional optional layers that can be disposed on the transparent casing 310 or the optional filler layer 330 are discussed in Section 5.6.

5.3 Materials for Use in Photovoltaic Module Substrates

In some embodiments, the elongated substrate 102 of FIG. 2A is made of a plastic, metal, metal alloy, glass, glass fibers, glass tubing, or glass tubing. In some embodiments, the elongated substrate 102 is made of a urethane polymer, an acrylic polymer, a fluoropolymer, polybenzamidazole, polyimide, polytetrafluoroethylene, polyetheretherketone, polyamide-imide, glass-based phenolic, polystyrene, cross-linked polystyrene, polyester, polycarbonate, polyethylene, polyethylene, acrylonitrile-butadiene-styrene, polytetrafluoroethylene, polymethacrylate, nylon 6,6, cellulose acetate butyrate, cellulose acetate, rigid vinyl, plasticized vinyl, or polypropylene. In some embodiments, substrate 102 is made of aluminosilicate glass, borosilicate glass (e.g., PYREX, DURAN, SIMAX, etc.), dichroic glass, germanium/semiconductor glass, glass ceramic, silicate/fused silica glass, soda lime glass, quartz glass, chalcogenide/sulphide glass, fluoride glass, pyrex glass, a glass-based phenolic, cereated glass, or flint glass.

In some embodiments, the elongated substrate 102 is made of a material such as polybenzamidazole (e.g., CELAZOLE®, available from Boedeker Plastics, Inc., Shiner, Tex.). In some embodiments, substrate 102 is made of polyimide (e.g., DUPONT™ VESPEL®, or DUPONT™ KAP- TON®, Wilmington, Del.). In some embodiments, the elongated substrate 102 is made of polytetrafluoroethylene (PTFE) or polyetheretherketone (PEEK), each of which is available from Boedeker Plastics, Inc. In some embodiments, the elongated substrate 102 is made of polyamide-imide (e.g., TORLON® PAI, Solvay Advanced Polymers, Alpharetta, Ga.).

In some embodiments, the elongated substrate 102 is made of a glass-based phenolic. Phenolic laminates are made by applying heat and pressure to layers of paper, canvas, linen or glass cloth impregnated with synthetic thermosetting resins. When heat and pressure are applied to the layers, a chemical reaction (polymerization) transforms the separate layers into a single laminated material with a "set" shape that cannot be softened again. Therefore, these materials are called "thermosets." A variety of resin types and cloth materials can be used to manufacture thermoset laminates with a range of mechanical, thermal, and electrical properties. In some embodiments, the elongated substrate 102 is a phenoloic laminate having a NEMA grade of G-3, G-5, G-7, G-9, G-10 or G-11. Exemplary phenolic laminates are available from Boedeker Plastics, Inc.

In some embodiments, the substrate 102 is made of polystyrene. Examples of polystyrene include general purpose polystyrene and high impact polystyrene as detailed in Marks' *Standard Handbook for Mechanical Engineers*, ninth edition, 1987, McGraw-Hill, Inc., p. 6-174, which is hereby incorporated by reference herein in its entirety. In still other embodiments, the elongated substrate 102 is made of cross-linked polystyrene. One example of cross-linked polystyrene is REXOLITE® (C-Lec Plastics, Inc). REXOLITE is a thermoset, in particular a rigid and translucent plastic produced by cross linking polystyrene with divinylbenzene.

In some embodiments, the elongated substrate 102 is a polyester wire (e.g., a MYLAR® wire). MYLAR® is available from DuPont Teijin Films (Wilmington, Del.). In still other embodiments, the elongated substrate 102 is made of DURASTONE®, which is made by using polyester, vinylester, epoxid and modified epoxy resins combined with glass fibers (Roechling Engineering Plastic Pte Ltd., Singapore).

In still other embodiments, the elongated substrate 102 is made of polycarbonate. Such polycarbonates can have varying amounts of glass fibers (e.g., 10% or more, 20% or more, 30% or more, or 40% or more) in order to adjust tensile strength, stiffness, compressive strength, as well as the thermal expansion coefficient of the material. Exemplary polycarbonates are ZELUX® M and ZELUX® W, which are available from Boedeker Plastics, Inc.

In some embodiments, the elongated substrate 102 is made of polyethylene. In some embodiments, the elongated substrate 102 is made of low density polyethylene (LDPE), high density polyethylene (HDPE), or ultra high molecular weight polyethylene (UHMW PE). Chemical properties of HDPE are described in Marks' *Standard Handbook for Mechanical Engineers*, ninth edition, 1987, McGraw-Hill, Inc., p. 6-173, which is hereby incorporated by reference herein in its entirety. In some embodiments, the elongated substrate 102 is made of acrylonitrile-butadiene-styrene, polytetrifluoro-ethylene (TEFLON), polymethacrylate (lucite or plexiglass), nylon 6,6, cellulose acetate butyrate, cellulose acetate, rigid vinyl, plasticized vinyl, or polypropylene. Chemical properties of these materials are described in Marks' *Standard Handbook for Mechanical Engineers*, ninth edition, 1987, McGraw-Hill, Inc., pp. 6-172 through 6-175, which is hereby incorporated by reference herein in its entirety.

Additional exemplary materials that can be used to form the elongated substrate 102 are found in *Modern Plastics Encyclopedia*, McGraw-Hill; Reinhold Plastics Applications Series, Reinhold Roff, *Fibres, Plastics and Rubbers*, Butterworth; Lee and Neville, Epoxy Resins, McGraw-Hill; Bilmetyer, *Textbook of Polymer Science*, Interscience; Schmidt and Marlies, *Principles of high polymer theory and practice*, McGraw-Hill; Beadle (ed.), *Plastics*, Morgan-Grampiand, Ltd., 2 vols. 1970; Tobolsky and Mark (eds.), *Polymer Science and Materials*, Wiley, 1971; Glanville, *The Plastics's Engineer's Data Book*, Industrial Press, 1971; Mohr (editor and senior author), Oleesky, Shook, and Meyers, *SPI Handbook of Technology and Engineering of Reinforced Plastics Composites*, Van Nostrand Reinhold, 1973, each of which is hereby incorporated by reference herein in its entirety.

The present application is not limited to substrates that have rigid cylindrical shapes or are solid rods. All or a portion of the elongated substrate 102 can be characterized by a cross-section bounded by any one of a number of shapes other than the circular shaped depicted in FIG. 2B. The bounding shape can be any one of circular, ovoid, or any shape characterized by one or more smooth curved surfaces, or any splice of smooth curved surfaces. The bounding shape can also be linear in nature, including triangular, rectangular, pentangular, hexagonal, or having any number of linear segmented surfaces. The bounding shape can be an n-gon, where n is 3, 5, or greater than 5. Or, the cross-section can be bounded by any combination of linear surfaces, arcuate surfaces, or curved surfaces. The bounding shape can be any shape that includes at least one arcuate edge. As described herein, for ease of discussion only, an omnifacial circular cross-section is illustrated to represent nonplanar embodiments of the elongated photovoltaic module 200. However, it should be noted that any cross-sectional geometry may be used in an elongated photovoltaic module 200.

In some embodiments, a first portion of the elongated substrate 102 is characterized by a first cross-sectional shape and a second portion of the elongated substrate 102 is characterized by a second cross-sectional shape, where the first and second cross-sectional shapes are the same or different. In some embodiments, at least ten percent, at least twenty percent, at least thirty percent, at least forty percent, at least fifty percent, at least sixty percent, at least seventy percent, at least eighty percent, at least ninety percent or all of the length of the elongated substrate 102 is characterized by the first cross-sectional shape. In some embodiments, the first cross-sectional shape is planar (e.g., has no arcuate side) and the second cross-sectional shape has at least one arcuate side.

In some embodiments, a cross-section of the elongated substrate 102 is circumferential and has an outer diameter of between 3 mm and 100 mm, between 4 mm and 75 mm, between 5 mm and 50 mm, between 10 mm and 40 mm, or between 14 mm and 17 mm. In some embodiments, a cross-section of the elongated substrate 102 is circumferential and has an outer diameter of between 1 mm and 1000 mm.

In some embodiments, the elongated substrate 102 is a tube with a hollowed inner portion. In such embodiments, a cross-section of the elongated substrate 102 is characterized by an inner radius defining the hollowed interior and an outer radius. The difference between the inner radius and the outer radius is the thickness of the elongated substrate 102. In some embodiments, the thickness of the elongated substrate 102 is between 0.1 mm and 20 mm, between 0.3 mm and 10 mm, between 0.5 mm and 5 mm, or between 1 mm and 2 mm. In some embodiments, the inner radius is between 1 mm and 100 mm, between 3 mm and 50 mm, or between 5 mm and 10 mm.

In some embodiments, the elongated substrate 102 has a length (perpendicular to the plane defined by FIG. 3B) that is between 5 mm and 10,000 mm, between 50 mm and 5,000 mm, between 100 mm and 3000 mm, or between 500 mm and 1500 mm. In one embodiment, the elongated substrate 102 is a hollowed tube having an outer diameter of 15 mm and a thickness of 1.2 mm, and a length of 1040 mm.

In some embodiments, the elongated substrate 102 has a width dimension and a longitudinal dimension. In some embodiments, the longitudinal dimension of the elongated substrate 102 is at least four times greater than the width dimension. In other embodiments, the longitudinal dimension of the elongated substrate 102 is at least five times greater than the width dimension. In yet other embodiments, the longitudinal dimension of the elongated substrate 102 is at least six times greater than the width dimension. In some embodiments, the longitudinal dimension of the elongated substrate 102 is 10 cm or greater. In other embodiments, the longitudinal dimension of the elongated substrate 102 is 50 cm or greater. In some embodiments, the width dimension of the elongated substrate 102 is 1 cm or greater. In other embodiments, the width dimension of the elongated substrate 102 is 5 cm or greater. In yet other embodiments, the width dimension of the elongated substrate 102 is 10 cm or greater.

5.4 Exemplary Semiconductor Junctions

Figure 4A:
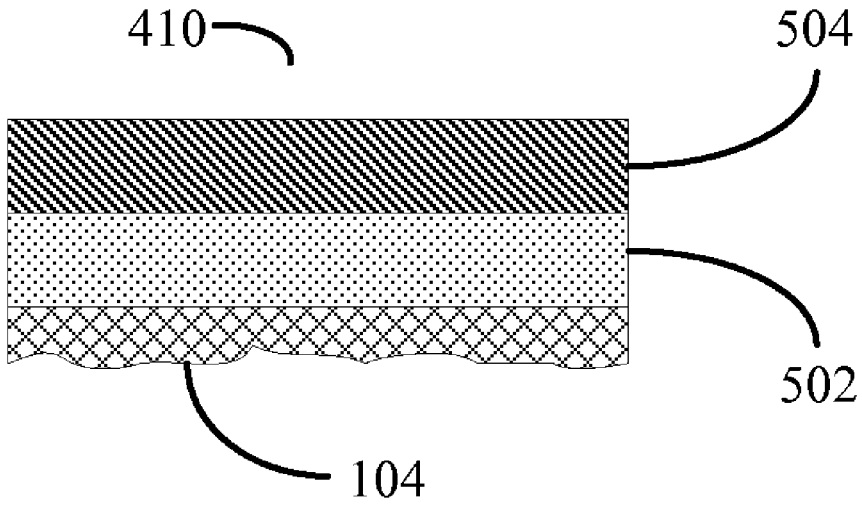
FIGS. 4A-4B illustrate semiconductor junctions in accordance with embodiments of the present disclosure.

Referring to FIG. 4A, in one embodiment, the semiconductor junction 410 is a heterojunction between an absorber layer 502, disposed on the back-electrode 104, and a junction partner layer 504, disposed on the absorber layer 502.

In some embodiments, the absorber layer 502 comprises one or more inorganic materials disclosed in this Section 5.4 or a subsection thereof. In some embodiments, the absorber layer 504 comprises one or more inorganic materials disclosed in this Section 5.4 or a subsection thereof.

In some embodiments, the absorber layer 502 consists of one or more inorganic materials disclosed in this Section 5.4 or a subsection thereof. In some embodiments, the absorber layer 504 consists of one or more inorganic materials disclosed in this Section 5.4 or a subsection thereof.

In some embodiments, the absorber layer 502 comprises one or more inorganic materials disclosed in this Section 5.4 or a subsection thereof as well as a polymer or other organic composition. In some embodiments, the absorber layer 504 comprises one or more inorganic materials disclosed in this Section 5.4 or a subsection thereof as well as a polymer or other organic composition.

In some embodiments, the absorber layer 502 comprises a polymer or other organic composition. In some embodiments, the absorber layer 504 comprises a polymer or other organic composition. In some embodiments, the semiconductor junction 410 is a dye-sensitized solar cell. In some embodiments, the semiconductor junction 410 comprises an electrolyte.

In some embodiments, the absorber layer 502 does not include a polymer. In some embodiments, the junction partner layer 502 does not include a polymer. In some embodiments, the semiconductor junction 410 is not a dye-sensitized solar cell. In some embodiments the semiconductor junction 410 does not comprise an electrolyte.

In some embodiments, at least sixty percent, at least seventy percent, at least eighty percent, at least ninety percent, or at least ninety-five percent of the photovoltaic current generated by the photovoltaic modules disclosed herein is generated by absorption of light having wavelengths in the range of 380 nm to 1200 nm by an inorganic semiconductor in the semiconductor junction 410.

In some embodiments, at least sixty percent, at least seventy percent, at least eighty percent, at least ninety percent, or at least ninety-five percent of the photovoltaic current generated by the photovoltaic modules disclosed herein is generated by absorption of light having wavelengths in the range of 380 nm to 1000 nm by an inorganic semiconductor in the semiconductor junction 410.

In some embodiments, at least sixty percent, at least seventy percent, at least eighty percent, at least ninety percent, or at least ninety-five percent of the photovoltaic current generated by the photovoltaic modules disclosed herein is generated by absorption of light having wavelengths in the range of 380 nm to 850 nm by an inorganic semiconductor in the semiconductor junction 410.

In some embodiments, at least sixty percent, at least seventy percent, at least eighty percent, at least ninety percent, or at least ninety-five percent of the photovoltaic current generated by the photovoltaic modules disclosed herein is generated by absorption of light having wavelengths in the range of 380 nm to 750 nm by an inorganic semiconductor in the semiconductor junction 410. For a description of photovoltaic module spectral response as a function of spectral band wavelength, see Field, 1997, "Solar Cell Spectral Response Measurement Errors Related to Spectral Band Width and Chopped Light Waveform," 26$^{th}$ IEEE Photovoltaic Specialists Conference, Sep. 29 through Oct. 3, 1997, Anaheim Calif., which is hereby incorporated by reference herein in its entirety.

In some embodiments, the layers 502 and 504 are composed of different semiconductors with different band gaps and electron affinities such that the junction partner layer 504 has a larger band gap than the absorber layer 502. In some embodiments, the absorber layer 502 is p-doped and the junction partner layer 504 is n-doped. In such embodiments, the transparent conductor 110 is $n^+$-doped. In alternative embodiments, the absorber layer 502 is n-doped and the junction partner layer 504 is p-doped. In such embodiments, the transparent conductor 110 is $p^+$-doped. In some embodiments, the semiconductors listed in Pandey, *Handbook of Semiconductor Electrodeposition*, Marcel Dekker Inc., 1996, Appendix 5, which is hereby incorporated by reference herein in its entirety, are used to form the semiconductor junction 410.

In some embodiments, the absorber layer 502 comprises a p-type semiconductor. In some embodiments, the junction partner layer 504 comprises an n-type semiconductor. In some embodiments, the absorber layer 502 comprises a p-type semiconductor and the junction partner layer 504 comprises an n-type semiconductor.

In some embodiments, the absorber layer 502 comprises an n-type semiconductor. In some embodiments, the junction partner layer 504 comprises p-type semiconductor. In some embodiments, the absorber layer 502 comprises an n-type semiconductor and the junction partner layer 504 comprises p-type semiconductor.

In some embodiments, the absorber layer 502 consists of a p-type semiconductor. In some embodiments, the junction partner layer 504 consists of an n-type semiconductor. In some embodiments, the absorber layer 502 consists of a p-type semiconductor and the junction partner layer 504 consists of an n-type semiconductor. In some embodiments, the absorber layer 502 consists of an n-type semiconductor.

In some embodiments, the junction partner layer 504 consists of a p-type semiconductor. In some embodiments, the absorber layer 502 consists of an n-type semiconductor and the junction partner layer 504 consists of a p-type semiconductor.

In some embodiments, the semiconductor junction 410 does not comprise a photosensitizing dye. For example, in some embodiments, the semiconductor junction 410 does not comprise phthalocyanines or porphyrins. In some embodiments, the semiconductor junction 410 does comprise a photosensitizing dye such as phthalocyanines or porphyrins.

5.4.1 Thin-Film Semiconductor Junctions Based on Copper Indium Diselenide and Other Type I-III-VI Materials Continuing to refer to FIG. 4A, in some embodiments, the absorber layer 502 is a group I-III-$VI_2$ compound such as copper indium di-selenide ($CuInSe_2$; also known as CIS). In some embodiments, the absorber layer 502 is a group I-III-$VI_2$ ternary compound selected from the group consisting of $CdGeAs_2$, $ZnSnAs_2$, $CuInTe_2$, $AgInTe_2$, $CuInSe_2$, $CuGaTe_2$, $ZnGeAs_2$, $CdSnP_2$, $AgInSe_2$, $AgGaTe_2$, $CuInS_2$, $CdSiAs_2$, $ZnSnP_2$, $CdGeP_2$, $ZnSnAs_2$, $CuGaSe_2$, $AgGaSe_2$, $AgInS_2$, $ZnGeP_2$, $ZnSiAs_2$, $ZnSiP_2$, $CdSiP_2$, or $CuGaS_2$ of either the p-type or the n-type when such compound is known to exist.

In some embodiments, the junction partner layer 504 is CdS, ZnS, ZnSe, or CdZnS. In one embodiment, the absorber layer 502 is p-type CIS and the junction partner layer 504 is $n^-$type CdS, ZnS, ZnSe, or CdZnS. Such semiconductor junctions 410 are described in Chapter 6 of Bube, *Photovoltaic Materials,* 1998, Imperial College Press, London, which is hereby incorporated by reference herein in its entirety. Such semiconductor junctions 410 are described in Chapter 6 of Bube, *Photovoltaic Materials,* 1998, Imperial College Press, London, which is hereby incorporated by reference herein in its entirety.

In some embodiments, the absorber layer 502 is copper-indium-gallium-diselenide (CIGS). Such a layer is also known as $Cu(InGa)Se_2$. In some embodiments, the absorber layer 502 is copper-indium-gallium-diselenide (CIGS) and the junction partner layer 504 is CdS, ZnS, ZnSe, or CdZnS. In some embodiments, the absorber layer 502 is p-type CIGS and the junction partner layer 504 is n-type CdS, ZnS, ZnSe, or CdZnS. Such semiconductor junctions 410 are described in Chapter 13 of *Handbook of Photovoltaic Science and Engineering,* 2003, Luque and Hegedus (eds.), Wiley & Sons, West Sussex, England, Chapter 12, which is hereby incorporated by reference herein in its entirety. In some embodiments, CIGS is deposited using techniques disclosed in Beck and Britt, Final Technical Report, January 2006, NREL/SR-520-39119; and Delahoy and Chen, August 2005, "Advanced CIGS Photovoltaic Technology," subcontract report; Kapur et al., January 2005 subcontract report, NREL/SR-520-37284, "Lab to Large Scale Transition for Non-Vacuum Thin Film CIGS Solar Cells"; Simpson et al., October 2005 subcontract report, "Trajectory-Oriented and Fault-Tolerant-Based Intelligent Process Control for Flexible CIGS PV Module Manufacturing," NREL/SR-520-38681; and Ramanathan et al., 31$^{st}$ IEEE Photovoltaics Specialists Conference and Exhibition, Lake Buena Vista, Fla., Jan. 3-7, 2005, each of which is hereby incorporated by reference herein in its entirety.

In some embodiments the absorber layer 502 is CIGS grown on a molybdenum back-electrode 104 by evaporation from elemental sources in accordance with a three stage process described in Ramanthan et al., 2003, "Properties of 19.2% Efficiency ZnO/CdS/$CuInGaSe_2$ Thin-film Solar Cells," Progress in Photovoltaics: Research and Applications 11, 225, which is hereby incorporated by reference herein in its entirety. In some embodiments the layer 504 is a ZnS(O, OH) buffer layer as described, for example, in Ramanathan et al., Conference Paper, "CIGS Thin-Film Solar Research at NREL: FY04 Results and Accomplishments," NREL/CP-520-37020, January 2005, which is hereby incorporated by reference herein in its entirety.

In some embodiments, the layer 502 is between 0.5 μm and 2.0 μm thick. In some embodiments, the composition ratio of Cu/(In+Ga) in the layer 502 is between 0.7 and 0.95. In some embodiments, the composition ratio of Ga/(In+Ga) in the layer 502 is between 0.2 and 0.4. In some embodiments the CIGS absorber has a <110> crystallographic orientation. In some embodiments the CIGS absorber has a <112> crystallographic orientation. In some embodiments the CIGS absorber is randomly oriented.

5.4.2 Semiconductor Junctions Based on Gallium Arsenide and Other Type III-V Materials In some embodiments, the semiconductor junctions 410 are based upon gallium arsenide (GaAs) or other III-V materials such as InP, AlSb, and CdTe. GaAs is a direct-band gap material having a band gap of 1.43 eV and can absorb 97% of AM1 radiation in a thickness of about two microns. Suitable type III-V junctions that can serve as semiconductor junctions 410 of the present application are described in Chapter 4 of Bube, *Photovoltaic Materials,* 1998, Imperial College Press, London, which is hereby incorporated by reference in its entirety.

Furthermore, in some embodiments the semiconductor junction 410 is a hybrid multijunction solar cell such as a GaAs/Si mechanically stacked multijunction as described by Gee and Virshup, 1988, 20$^{th}$ *IEEE Photovoltaic Specialist Conference*, IEEE Publishing, New York, p. 754, which is hereby incorporated by reference herein in its entirety, a GaAs/$CuInSe_2$ MSMJ four-terminal device, consisting of a GaAs thin film top cell and a ZnCdS/$CuInSe_2$ thin bottom cell described by Stanbery et al., 19$^{th}$ *IEEE Photovoltaic Specialist Conference*, IEEE Publishing, New York, p. 280, and Kim et al., 20$^{th}$ *IEEE Photovoltaic Specialist Conference*, IEEE Publishing, New York, p. 1487, each of which is hereby incorporated by reference herein in its entirety. Other hybrid multijunction solar cells are described in Bube, *Photovoltaic Materials,* 1998, Imperial College Press, London, pp. 131-132, which is hereby incorporated by reference herein in its entirety.

Figure 4B:
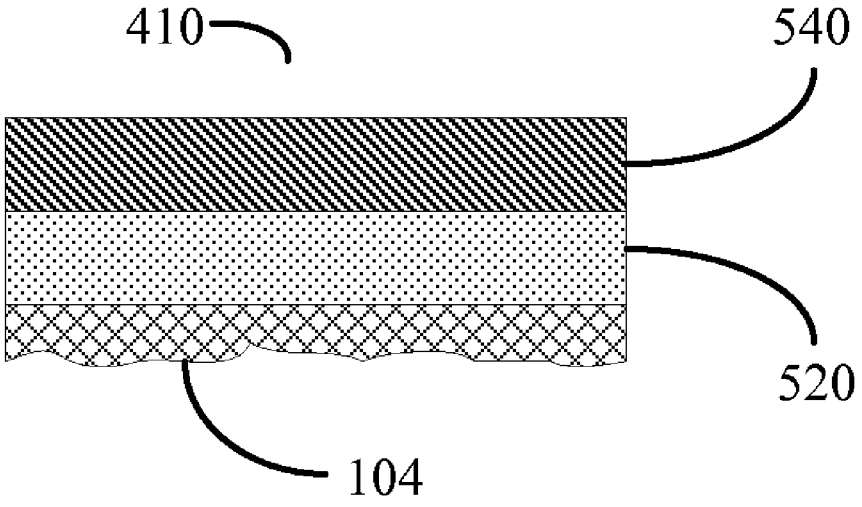

5.4.3 Semiconductor Junctions Based on Cadmium Telluride and Other Type II-VI Materials In some embodiments, the semiconductor junctions 410 are based upon II-VI compounds that can be prepared in either the n-type or the p-type form. Accordingly, in some embodiments, referring to FIG. 4B, the semiconductor junction 410 is a p-n heterojunction in which the layers 520 and 540 are any combination set forth in the following table or alloys thereof.

| Layer 520 | Layer 540 |
|---|---|
| n-CdSe | p-CdTe |
| n-ZnCdS | p-CdTe |
| n-ZnSSe | p-CdTe |
| p-ZnTe | n-CdSe |
| n-CdS | p-CdTe |
| n-CdS | p-ZnTe |
| p-ZnTe | n-CdTe |
| n-ZnSe | p-CdTe |
| n-ZnSe | p-ZnTe |

-continued

| Layer 520 | Layer 540 |
|---|---|
| n-ZnS | p-CdTe |
| n-ZnS | p-ZnTe |

Methods for manufacturing semiconductor junctions 410 based upon II-VI compounds are described in Chapter 4 of Bube, *Photovoltaic Materials,* 1998, Imperial College Press, London, which is hereby incorporated by reference herein in its entirety.

5.5 Embodiments of the Optional Filler Layer

The optional filler layer 330 in FIGS. 2A and 2B can be made of sealant such as ethylene vinyl acetate (EVA), silicone, silicone gel, epoxy, polydimethyl siloxane (PDMS), RTV silicone rubber, polyvinyl butyral (PVB), thermoplastic polyurethane (TPU), a polycarbonate, an acrylic, a fluoropolymer, and/or a urethane is coated over the transparent conductor 110 to seal out air and, optionally, to provide complementary fitting to a transparent casing 310. In some embodiments, the filler layer 330 is a Q-type silicone, a silsequioxane, a D-type silicone, or an M-type silicone.

In one embodiment, the substance used to form a filler layer 330 comprises a resin or resin-like substance, the resin potentially being added as one component, or added as multiple components that interact with one another to effect a change in viscosity. In another embodiment, the resin can be diluted with a less viscous material, such as a silicone-based oil or liquid acrylates. In these cases, the viscosity of the initial substance can be far less than that of the resin material itself.

In one example, a medium viscosity polydimethylsiloxane mixed with an elastomer-type dielectric gel can be used to make the filler layer 330. In one case, as an example, a mixture of 85% (by weight) Dow Corning 200 fluid, 50 centistoke viscosity (PDMS, polydimethylsiloxane); 7.5% Dow Corning 3-4207 Dielectric Tough Gel, Part A—Resin; and 7.5% Dow Corning 3-4207 Dielectric Tough Gel, Part B—Catalyst is used to form the filler layer 330. Other oils, gels, or silicones can be used to produce much of what is described in this disclosure and, accordingly, this disclosure should be read to include those other oils, gels and silicones to generate the described filler layer 330. Such oils include silicone-based oils, and the gels include many commercially available dielectric gels. Curing of silicones can also extend beyond a gel like state. Commercially available dielectric gels and silicones and the various formulations are contemplated as being usable in this disclosure.

In one example, the composition used to form the filler layer 330 is 85%, by weight, polydimethylsiloxane polymer liquid, where the polydimethylsiloxane has the chemical formula $(CH_3)_3SiO[SiO(CH_3)_2]_nSi(CH_3)_3$, where n is a range of integers chosen such that the polymer liquid has an average bulk viscosity that falls in the range between 50 centistokes and 100,000 centistokes (all viscosity values given herein for compositions assume that the compositions are at room temperature). Thus, there may be polydimethylsiloxane molecules in the polydimethylsiloxane polymer liquid with varying values for n provided that the bulk viscosity of the liquid falls in the range between 50 centistokes and 100,000 centistokes. Bulk viscosity of the polydimethylsiloxane polymer liquid may be determined by any of a number of methods known to those of skill in the art, such as using a capillary viscometer. Further, the composition includes 7.5%, by weight, of a silicone elastomer comprising at least sixty percent, by weight, dimethylvinyl-terminated dimethyl siloxane (CAS number 68083-19-2) and between 3 and 7 percent by weight silicate (New Jersey TSRN 14962700-537 6P). Further, the composition includes 7.5%, by weight, of a silicone elastomer comprising at least sixty percent, by weight, dimethylvinyl-terminated dimethyl siloxane (CAS number 68083-19-2), between ten and thirty percent by weight hydrogen-terminated dimethyl siloxane (CAS 70900-21-9) and between 3 and 7 percent by weight trimethylated silica (CAS number 68909-20-6).

In some embodiments, the filler layer 330 is formed by soft and flexible optically suitable material such as silicone gel. For example, in some embodiments, the filler layer 330 is formed by a silicone gel such as a silicone-based adhesive or sealant. In some embodiments, the filler layer 330 is formed by GE RTV 615 Silicone. RTV 615 is an optically clear, two-part flowable silicone product that requires SS4120 as primer for polymerization (RTV615-1P), both available from General Electric (Fairfield, Conn.). Silicone-based adhesives or sealants are based on tough silicone elastomeric technology. The characteristics of silicone-based materials, such as adhesives and sealants, are controlled by three factors: resin mixing ratio, potting life and curing conditions.

Advantageously, silicone adhesives have a high degree of flexibility and very high temperature resistance (up to 600° F.). Silicone-based adhesives and sealants have a high degree of flexibility. Silicone-based adhesives and sealants are available in a number of technologies (or cure systems). These technologies include pressure sensitive, radiation cured, moisture cured, thermo-set and room temperature vulcanizing (RTV). In some embodiments, the silicone-based sealants use two-component addition or condensation curing systems or single component (RTV) forms. RTV forms cure easily through reaction with moisture in the air and give off acid fumes or other by-product vapors during curing.

Pressure sensitive silicone adhesives adhere to most surfaces with very slight pressure and retain their tackiness. This type of material forms viscoelastic bonds that are aggressively and permanently tacky, and adheres without the need of more than finger or hand pressure. In some embodiments, radiation is used to cure silicone-based adhesives. In some embodiments, ultraviolet light, visible light or electron bean irradiation is used to initiate curing of sealants, which allows a permanent bond without heating or excessive heat generation. While UV-based curing requires one substrate to be UV transparent, the electron beam can penetrate through material that is opaque to UV light. Certain silicone adhesives and cyanoacrylates based on a moisture or water curing mechanism may need additional reagents properly attached to the photovoltaic module 402 without affecting the proper functioning of the solar cells 12 of the photovoltaic module. Thermo-set silicone adhesives and silicone sealants are cross-linked polymeric resins cured using heat or heat and pressure. Cured thermo-set resins do not melt and flow when heated, but they may soften. Vulcanization is a thermosetting reaction involving the use of heat and/or pressure in conjunction with a vulcanizing agent, resulting in greatly increased strength, stability and elasticity in rubber-like materials. RTV silicone rubbers are room temperature vulcanizing materials. The vulcanizing agent is a cross-linking compound or catalyst. In some embodiments in accordance with the present application, sulfur is added as the traditional vulcanizing agent.

In one example, the composition used to form a filler layer 330 is silicone oil mixed with a dielectric gel. The silicone oil is a polydimethylsiloxane polymer liquid, whereas the dielectric gel is a mixture of a first silicone elastomer and a second silicone elastomer. As such, the composition used to form the filler layer 330 is X %, by weight, polydimethylsiloxane polymer liquid, Y %, by weight, a first silicone elastomer, and Z %, by weight, a second silicone elastomer, where X, Y, and Z sum to 100. Here, the polydimethylsiloxane polymer liquid has the chemical formula $(CH_3)_3SiO[SiO(CH_3)_2]_nSi(CH_3)_3$, where n is a range of integers chosen such that the polymer liquid has an average bulk viscosity that falls in the range between 50 centistokes and 100,000 centistokes. Thus, there may be polydimethylsiloxane molecules in the polydimethylsiloxane polymer liquid with varying values for n provided that the bulk viscosity of the liquid falls in the range between 50 centistokes and 100,000 centistokes. The first silicone elastomer comprises at least sixty percent, by weight, dimethylvinyl-terminated dimethyl siloxane (CAS number 68083-19-2) and between 3 and 7 percent by weight silicate (New Jersey TSRN 14962700-537 6P). Further, the second silicone elastomer comprises at least sixty percent, by weight, dimethylvinyl-terminated dimethyl siloxane (CAS number 68083-19-2), between ten and thirty percent by weight hydrogen-terminated dimethyl siloxane (CAS 70900-21-9) and between 3 and 7 percent by weight trimethylated silica (CAS number 68909-20-6). In this embodiment, X may range between 30 and 90, Y may range between 2 and 20, and Z may range between 2 and 20, provided that X, Y and Z sum to 100 percent.

In another example, the composition used to form the filler layer 330 is silicone oil mixed with a dielectric gel. The silicone oil is a polydimethylsiloxane polymer liquid, whereas the dielectric gel is a mixture of a first silicone elastomer and a second silicone elastomer. As such, the composition used to form the filler layer 330 is X %, by weight, polydimethylsiloxane polymer liquid, Y %, by weight, a first silicone elastomer, and Z %, by weight, a second silicone elastomer, where X, Y, and Z sum to 100. Here, the polydimethylsiloxane polymer liquid has the chemical formula $(CH_3)_3 SiO[SiO(CH_3)_2]_nSi(CH_3)_3$, where n is a range of integers chosen such that the polymer liquid has a volumetric thermal expansion coefficient of at least $500\times10^{-6}/°$ C. Thus, there may be polydimethylsiloxane molecules in the polydimethylsiloxane polymer liquid with varying values for n provided that the polymer liquid has a volumetric thermal expansion coefficient of at least $960\times10^{-6}/°$ C. The first silicone elastomer comprises at least sixty percent, by weight, dimethylvinyl-terminated dimethyl siloxane (CAS number 68083-19-2) and between 3 and 7 percent by weight silicate (New Jersey TSRN 14962700-537 6P). Further, the second silicone elastomer comprises at least sixty percent, by weight, dimethylvinyl-terminated dimethyl siloxane (CAS number 68083-19-2), between ten and thirty percent by weight hydrogen-terminated dimethyl siloxane (CAS 70900-21-9) and between 3 and 7 percent by weight trimethylated silica (CAS number 68909-20-6). In this embodiment, X may range between 30 and 90, Y may range between 2 and 20, and Z may range between 2 and 20, provided that X, Y and Z sum to 100 percent.

In some embodiments, the composition used to form the filler layer 330 is a crystal clear silicone oil mixed with a dielectric gel. In some embodiments, the filler layer has a volumetric thermal coefficient of expansion of greater than $250\times10^{-6}/°$ C., greater than $300\times10^{-6}/°$ C., greater than $400\times10^{-6}/°$ C., greater than $500\times10^{-6}/°$ C., greater than $1000\times10^{-6}/°$ C., greater than $2000\times10^{-6}/°$ C., greater than $5000\times10^{-6}/°$ C., or between $250\times10^{-6}/°$ C. and $10000\times10^{-6}/°$ C.

In some embodiments, a silicone-based dielectric gel can be used in-situ to form the filler layer 330. The dielectric gel can also be mixed with a silicone based oil to reduce both beginning and ending viscosities. The ratio of silicone-based oil by weight in the mixture can be varied. The percentage of silicone-based oil by weight in the mixture of silicone-based oil and silicone-based dielectric gel can have values at or about (e.g. ±2.5%) 25%, 30%, 35%, 40%, 45%, 50%, 55%, 60%, 65%, 70%, 75%, and 85%. Ranges of 20%-30%, 25%-35%, 30%-40%, 35%-45%, 40%-50%, 45%-55%, 50%-60%, 55%-65%, 60%-70%, 65%-75%, 70%-80%, 75%-85%, and 80%-90% (by weight) are also contemplated. Further, these same ratios by weight can be contemplated for the mixture when using other types of oils or acrylates instead of or in addition to silicon-based oil to lessen the beginning viscosity of the gel mixture alone.

The initial viscosity of the mixture of 85% Dow Corning 200 fluid, 50 centistoke viscosity (PDMS, polydimethylsiloxane); 7.5% Dow Corning 3-4207 Dielectric Tough Gel, Part A—Resin 7.5% Dow Corning 3 4207 Dielectric Tough Gel, Part B—Pt Catalyst is approximately 100 centipoise (cP). Beginning viscosities of less than 1, less than 5, less than 10, less than 25, less than 50, less than 100, less than 250, less than 500, less than 750, less than 1000, less than 1200, less than 1500, less than 1800, and less than 2000 cP are imagined, and any beginning viscosity in the range 1-2000 cP is acceptable. Other ranges can include 1-10 cP, 10-50 cP, 50-100 cP, 100-250 cP, 250-500 cP, 500-750 cP, 750-1000 cP, 800-1200 cP, 1000-1500 cP, 1250-1750 cP, 1500-2000 cP, and 1800-2000 cP. In some cases an initial viscosity between 1000 cP and 1500 cP can also be used.

A final viscosity for the filler layer 330 of well above the initial viscosity is envisioned in some embodiments. In most cases, a ratio of the final viscosity to the beginning viscosity is at least 50:1. With lower beginning viscosities, the ratio of the final viscosity to the beginning viscosity may be 20,000:1, or in some cases, up to 50,000:1. In most cases, a ratio of the final viscosity to the beginning viscosity of between 5,000:1 to 20,000:1, for beginning viscosities in the 10 cP range, may be used. For beginning viscosities in the 1000 cP range, ratios of the final viscosity to the beginning viscosity between 50:1 to 200:1 are imagined. In short order, ratios in the ranges of 200:1 to 1,000:1, 1,000:1 to 2,000:1, 2,000:1 to 5,000:1, 5,000:1 to 20,000:1, 20,000:1 to 50,000:1, 50,000:1 to 100,000:1, 100,000:1 to 150,000:1, and 150,000:1 to 200,000:1 are contemplated.

The final viscosity of the filler layer 330 is typically on the order of 50,000 cP to 200,000 cP. In some cases, a final viscosity of at least $1\times10^6$ cP is envisioned. Final viscosities of at least 50,000 cP, at least 60,000 cP, at least 75,000 cP, at least 100,000 cP, at least 150,000 cP, at least 200,000 cP, at least 250,000 cP, at least 300,000 cP, at least 500,000 cP, at least 750,000 cP, at least 800,000 cP, at least 900,000 cP, and at least $1\times10^6$ cP are found in alternative embodiments. Ranges of final viscosity for the filler layer can include 50,000 cP to 75,000 cP, 60,000 cP to 100,000 cP, 75,000 cP to 150,000 cP, 100,000 cP to 200,000 cP, 100,000 cP to 250,000 cP, 150,000 cP to 300,000 cP, 200,000 cP to 500,000 cP, 250,000 cP to 600,000 cP, 300,000 cP to 750,000 cP, 500,000 cP to 800,000 cP, 600,000 cP to 900,000 cP, and 750,000 cP to $1\times10^6$ cP.

Curing temperatures for the filler layer 330 can be numerous, with a common curing temperature of room temperature. The curing step need not involve adding thermal energy to the system. Temperatures that can be used for curing can be envisioned (with temperatures in degrees F.) at up to 60 degrees, up to 65 degrees, up to 70 degrees, up to 75 degrees, up to 80 degrees, up to 85 degrees, up to 90 degrees, up to 95 degrees, up to 100 degrees, up to 105 degrees, up to 110 degrees, up to 115 degrees, up to 120 degrees, up to 125 degrees, and up to 130 degrees, and temperatures generally between 55 and 130 degrees. Other curing temperature ranges can include 60-85 degrees, 70-95 degrees, 80-110 degrees, 90-120 degrees, and 100-130 degrees.

The working time of the substance of a mixture can be varied as well. The working time of a mixture in this context means the time for the substance (e.g., the substance used to form the filler layer 330) to cure to a viscosity more than double the initial viscosity when mixed. Working time for the layer can be varied. In particular, working times of less than 5 minutes, on the order of 10 minutes, up to 30 minutes, up to 1 hour, up to 2 hours, up to 4 hours, up to 6 hours, up to 8 hours, up to 12 hours, up to 18 hours, and up to 24 hours are all contemplated. A working time of 1 day or less is found to be best in practice. Any working time between 5 minutes and 1 day is acceptable.

In context of this disclosure, resin can mean both synthetic and natural substances that have a viscosity prior to curing and a greater viscosity after curing. The resin can be unitary in nature, or may be derived from the mixture of two other substances to form the resin.

In some embodiments, the optional filler layer 330 is a laminate layer such as any of those disclosed in United States Provisional patent application Ser. No. 12/039,659, filed Feb. 28, 2008, entitled "A Photovoltaic Apparatus Having a Laminate Layer and Method for Making the Same" which is hereby incorporated by reference herein in its entirety for such purpose. In some embodiments, the filler layer 330 has a viscosity of less than $1\times10^6$ cP. In some embodiments, the filler layer 330 has a thermal coefficient of expansion of greater than $500\times10^{-6}$/° C. or greater than $1000\times10^{-6}$/° C. In some embodiments, the filler layer 330 comprises epolydimethylsiloxane polymer. In some embodiments, the filler layer 330 comprises by weight: less than 50% of a dielectric gel or components to form a dielectric gel; and at least 30% of a transparent silicone oil, the transparent silicone oil having a beginning viscosity of no more than half of the beginning viscosity of the dielectric gel or components to form the dielectric gel. In some embodiments, the filler layer 330 has a thermal coefficient of expansion of greater than $500\times10^{-6}$/° C. and comprises by weight: less than 50% of a dielectric gel or components to form a dielectric gel; and at least 30% of a transparent silicone oil. In some embodiments, the filler layer 330 is formed from silicone oil mixed with a dielectric gel. In some embodiments, the silicone oil is a polydimethylsiloxane polymer liquid and the dielectric gel is a mixture of a first silicone elastomer and a second silicone elastomer. In some embodiments, the filler layer 330 is formed from X %, by weight, polydimethylsiloxane polymer liquid, Y %, by weight, a first silicone elastomer, and Z %, by weight, a second silicone elastomer, where X, Y, and Z sum to 100. In some embodiments, the polydimethylsiloxane polymer liquid has the chemical formula $(CH_3)_3SiO[SiO(CH_3)_2]_nSi(CH_3)_3$, where n is a range of integers chosen such that the polymer liquid has an average bulk viscosity that falls in the range between 50 centistokes and 100,000 centistokes. In some embodiments, first silicone elastomer comprises at least sixty percent, by weight, dimethylvinyl-terminated dimethyl siloxane and between 3 and 7 percent by weight silicate. In some embodiments, the second silicone elastomer comprises: (i) at least sixty percent, by weight, dimethylvinyl-terminated dimethyl siloxane; (ii) between ten and thirty percent by weight hydrogen-terminated dimethyl siloxane; and (iii) between 3 and 7 percent by weight trimethylated silica. In some embodiments, X is between 30 and 90; Y is between 2 and 20; and Z is between 2 and 20.

In some embodiments, the filler layer comprises a silicone gel composition, comprising: (A) 100 parts by weight of a first polydiorganosiloxane containing an average of at least two silicon-bonded alkenyl groups per molecule and having a viscosity of from 0.2 to 10 Pa·s at 25° C.; (B) at least about 0.5 part by weight to about 10 parts by weight of a second polydiorganosiloxane containing an average of at least two silicon-bonded alkenyl groups per molecule, wherein the second polydiorganosiloxane has a viscosity at 25° C. of at least four times the viscosity of the first polydiorganosiloxane at 25° C.; (C) an organohydrogensiloxane having the average formula $R_7Si(SiOR^8{}_2H)_3$ where $R^7$ is an alkyl group having 1 to 18 carbon atoms or aryl, $R^8$ is an alkyl group having 1 to 4 carbon atoms, in an amount sufficient to provide from 0.1 to 1.5 silicon-bonded hydrogen atoms per alkenyl group in components (A) and (B) combined; and (D) a hydrosilylation catalyst in an amount sufficient to cure the composition as disclosed in U.S. Pat. No. 6,169,155, which is hereby incorporated by reference herein in its entirety.

5.6 Additional Optional Layers and Components

Optional water resistant layer. In some embodiments, one or more layers of water resistant material are coated over the elongated photovoltaic module to waterproof the elongated photovoltaic module. In some embodiments of FIGS. 2A to 2C, this water resistant layer is coated onto the transparent conductor 110, the optional filler layer 330, the optional transparent tubular casing 310, and/or an optional antireflective coating described below. For example, in some embodiments, such water resistant layers are circumferentially disposed onto the optional filler layer 330 prior to encasing the elongated photovoltaic module 200 in optional transparent casing 310. In some embodiments, such water resistant layers are circumferentially disposed onto transparent casing 310 itself. In embodiments where a water resistant layer is provided to waterproof the elongated photovoltaic module, the optical properties of the water resistant layer are chosen so that they do not interfere with the absorption of incident light by the elongated photovoltaic module. In some embodiments, the water resistant layer is made of clear silicone, SiN, $SiO_xN_y$, $SiO_x$, or $Al_2O_3$, where x and y are integers. In some embodiments, the water resistant layer is made of a Q-type silicone, a silsequioxane, a D-type silicone, or an M-type silicone.

Optional antireflective coating. In some embodiments, an optional antireflective coating is also disposed onto the transparent conductor 110, the optional filler layer 330, the optional transparent tubular casing 310, and/or the optional water resistant layer described above in order to maximize solar cell efficiency. In some embodiments, there is a both a water resistant layer and an antireflective coating deposited on the transparent conductor 110, the optional filler layer 330, and/or the optional transparent casing 310.

In some embodiments, a single layer serves the dual purpose of a water resistant layer and an anti-reflective coating. In some embodiments, the antireflective coating is made of $MgF_2$, silicone nitride, titanium nitride, silicon monoxide (SiO), or silicon oxide nitride. In some embodiments, there is more than one layer of antireflective coating. In some embodiments, there is more than one layer of antireflective coating and each layer is made of the same material. In some embodiments, there is more than one layer of antireflective coating and each layer is made of a different material.

Optional fluorescent material. In some embodiments, a fluorescent material (e.g., luminescent material, phosphorescent material) is coated on a surface of a layer of the elongated photovoltaic module. In some embodiments, the fluorescent material is coated on the luminal surface and/or the exterior surface of the transparent conductor 110, the optional filler layer 330, and/or the optional transparent casing 310. In some embodiments, the elongated photovoltaic module includes a water resistant layer and the fluorescent material is coated on the water resistant layer. In some embodiments, more than one surface of an elongated photovoltaic module is coated with optional fluorescent material. In some embodiments, the fluorescent material absorbs blue and/or ultraviolet light, which some semiconductor junctions 410 of the present application do not use to convert to electricity, and the fluorescent material emits light in visible and/or infrared light which is useful for electrical generation in some solar cells 300 of the present application.

Fluorescent, luminescent, or phosphorescent materials can absorb light in the blue or UV range and emit visible light. Phosphorescent materials, or phosphors, usually comprise a suitable host material and an activator material. The host materials are typically oxides, sulfides, selenides, halides or silicates of zinc, cadmium, manganese, aluminum, silicon, or various rare earth metals. The activators are added to prolong the emission time.

In some embodiments of the application, phosphorescent materials are incorporated in the systems and methods of the present application to enhance light absorption by the solar cells 700 (12) of the elongated photovoltaic module 200. In some embodiments, the phosphorescent material is directly added to the material used to make the optional transparent casing 310. In some embodiments, the phosphorescent materials are mixed with a binder for use as transparent paints to coat various outer or inner layers of the solar cells 700 (12) of the elongated photovoltaic module 200, as described above.

Exemplary phosphors include, but are not limited to, copper-activated zinc sulfide (ZnS:Cu) and silver-activated zinc sulfide (ZnS:Ag). Other exemplary phosphorescent materials include, but are not limited to, zinc sulfide and cadmium sulfide (ZnS:CdS), strontium aluminate activated by europium ($SrAlO_3$:Eu), strontium titanium activated by praseodymium and aluminum (SrTiO3:Pr, Al), calcium sulfide with strontium sulfide with bismuth ((Ca,Sr)S:Bi), copper and magnesium activated zinc sulfide (ZnS:Cu,Mg), or any combination thereof.

Methods for creating phosphor materials are known in the art. For example, methods of making ZnS:Cu or other related phosphorescent materials are described in U.S. Pat. Nos. 2,807,587 to Butler et al.; 3,031,415 to Morrison et al.; 3,031,416 to Morrison et al.; 3,152,995 to Strock; 3,154,712 to Payne; 3,222,214 to Lagos et al.; 3,657,142 to Poss; 4,859,361 to Reilly et al., and 5,269,966 to Karam et al., each of which is hereby incorporated by reference herein in its entirety. Methods for making ZnS:Ag or related phosphorescent materials are described in U.S. Pat. Nos. 6,200,497 to Park et al., 6,025,675 to Ihara et al.; 4,804,882 to Takahara et al., and 4,512,912 to Matsuda et al., each of which is hereby incorporated by reference herein in its entirety. Generally, the persistence of the phosphor increases as the wavelength decreases. In some embodiments, quantum dots of CdSe or similar phosphorescent material can be used to get the same effects. See Dabbousi et al., 1995, "Electroluminescence from CdSe quantum-dot/polymer composites," Applied Physics Letters 66 (11): 1316-1318; Dabbousi et al., 1997 "(CdSe)ZnS Core-Shell Quantum Dots: Synthesis and Characterization of a Size Series of Highly Luminescent Nanocrystallites," J. Phys. Chem. B, 101: 9463-9475; Ebenstein et al., 2002, "Fluorescence quantum yield of CdSe:ZnS nanocrystals investigated by correlated atomic-force and single-particle fluorescence microscopy," Applied Physics Letters 80: 1023-1025; and Peng et al., 2000, "Shape control of CdSe nanocrystals," Nature 404: 59-61; each of which is hereby incorporated by reference herein in its entirety.

In some embodiments, optical brighteners are used in the optional fluorescent layers of the present application. Optical brighteners (also known as optical brightening agents, fluorescent brightening agents or fluorescent whitening agents) are dyes that absorb light in the ultraviolet and violet region of the electromagnetic spectrum, and re-emit light in the blue region. Such compounds include stilbenes (e.g., trans-1,2-diphenylethylene or (E)-1,2-diphenylethene). Another exemplary optical brightener that can be used in the optional fluorescent layers of the present application is umbelliferone (7-hydroxycoumarin), which also absorbs energy in the UV portion of the spectrum. This energy is then re-emitted in the blue portion of the visible spectrum. More information on optical brighteners is in Dean, 1963, *Naturally Occurring Oxygen Ring Compounds*, Butterworths, London; Joule and Mills, 2000, *Heterocyclic Chemistry*, 4$^{th}$ edition, Blackwell Science, Oxford, United Kingdom; and Barton, 1999, *Comprehensive Natural Products Chemistry* 2: 677, Nakanishi and Meth-Cohn eds., Elsevier, Oxford, United Kingdom, 1999, each of which is hereby incorporated by reference herein in its entirety.

Layer construction. In some embodiments, some of the afore-mentioned layers are constructed using cylindrical magnetron sputtering techniques, conventional sputtering methods, or reactive sputtering methods on long tubes or strips. Sputtering coating methods for long tubes and strips are disclosed in for example, Hoshi et al., 1983, "Thin Film Coating Techniques on Wires and Inner Walls of Small Tubes via Cylindrical Magnetron Sputtering," *Electrical Engineering in Japan* 103:73-80; Lincoln and Blickensderfer, 1980, "Adapting Conventional Sputtering Equipment for Coating Long Tubes and Strips," *J. Vac. Sci. Technol.* 17:1252-1253; Harding, 1977, "Improvements in a dc Reactive Sputtering System for Coating Tubes," *J. Vac. Sci. Technol.* 14:1313-1315; Pearce, 1970, "A Thick Film Vacuum Deposition System for Microwave Tube Component Coating," *Conference Records of* 1970 *Conference on Electron Device Techniques* 208-211; and Harding et al., 1979, "Production of Properties of Selective Surfaces Coated onto Glass Tubes by a Magnetron Sputtering System," *Proceedings of the International Solar Energy Society* 1912-1916, each of which is hereby incorporated by reference herein in its entirety.

5.7 Definitions

Circumferentially disposed. In some embodiments of the present application, layers of material are successively circumferentially disposed on a non-planar elongated substrate in order to form solar cells 700 (12) of an elongated photovoltaic module 200 as well as the encapsulating layers of the elongated photovoltaic module such as filler layer 330 and the casing 310. As used herein, the term "circumferentially disposed" is not intended to imply that each such layer of material is necessarily deposited on an underlying layer or that the shape of the solar cell 700 (12) and/or the photovoltaic module 200 is cylindrical. In fact, the present application teaches methods by which such layers are molded or otherwise formed on an underlying layer. Further, as discussed above in conjunction with the discussion of the substrate 102, the substrate and underlying layers may have any of several different planar or nonplanar shapes. Nevertheless, the term "circumferentially disposed" means that an overlying layer is disposed on an underlying layer such that there is no space (e.g., no annular space) between the overlying layer and the underlying layer. Furthermore, as used herein, the term "circumferentially disposed" means that an overlying layer is disposed on at least fifty percent of the perimeter of the underlying layer. Furthermore, as used herein, the term "circumferentially disposed" means that an overlying layer is disposed along at least half of the length of the underlying layer. Furthermore, as used herein, the term "disposed" means that one layer is disposed on an underlying layer without any space between the two layers. So, if a first layer is disposed on a second layer, there is no space between the two layers. Furthermore, as used herein, the term circumferentially disposed means that an overlying layer is disposed on at least twenty percent, at least thirty percent, at least forty, percent, at least fifty percent, at least sixty percent, at least seventy percent, or at least eighty percent of the perimeter of the underlying layer. Furthermore, as used herein, the term circumferentially disposed means that an overlying layer is disposed along at least half of the length, at least seventy-five percent of the length, or at least ninety-percent of the underlying layer.

Rigid. In some embodiments, the substrate 102 is rigid. Rigidity of a material can be measured using several different metrics including, but not limited to, Young's modulus. In solid mechanics, Young's Modulus (E) (also known as the Young Modulus, modulus of elasticity, elastic modulus or tensile modulus) is a measure of the stiffness of a given material. It is defined as the ratio, for small strains, of the rate of change of stress with strain. This can be experimentally determined from the slope of a stress-strain curve created during tensile tests conducted on a sample of the material. Young's modulus for various materials is given in the following table.

| Material | Young's modulus (E) in GPa | Young's modulus (E) in $lbf/in^2$ (psi) |
|---|---|---|
| Rubber (small strain) | 0.01-0.1 | 1,500-15,000 |
| Low density polyethylene | 0.2 | 30,000 |
| Polypropylene | 1.5-2 | 217,000-290,000 |
| Polyethylene terephthalate | 2-2.5 | 290,000-360,000 |
| Polystyrene | 3-3.5 | 435,000-505,000 |
| Nylon | 3-7 | 290,000-580,000 |
| Aluminum alloy | 69 | 10,000,000 |
| Glass (all types) | 72 | 10,400,000 |
| Brass and bronze | 103-124 | 17,000,000 |
| Titanium (Ti) | 105-120 | 15,000,000-17,500,000 |
| Carbon fiber reinforced plastic (unidirectional, along grain) | 150 | 21,800,000 |
| Wrought iron and steel | 190-210 | 30,000,000 |
| Tungsten (W) | 400-410 | 58,000,000-59,500,000 |
| Silicon carbide (SiC) | 450 | 65,000,000 |
| Tungsten carbide (WC) | 450-650 | 65,000,000-94,000,000 |
| Single Carbon nanotube | 1,000+ | 145,000,000 |
| Diamond (C) | 1,050-1,200 | 150,000,000-175,000,000 |

In some embodiments of the present application, a material (e.g., substrate 102) is deemed to be rigid when it is made of a material that has a Young's modulus of 20 GPa or greater, 30 GPa or greater, 40 GPa or greater, 50 GPa or greater, 60 GPa or greater, or 70 GPa or greater. In some embodiments of the present application a material (e.g., the substrate 102) is deemed to be rigid when the Young's modulus for the material is a constant over a range of strains. Such materials are called linear, and are said to obey Hooke's law. Thus, in some embodiments, the substrate 102 is made out of a linear material that obeys Hooke's law. Examples of linear materials include, but are not limited to, steel, carbon fiber, and glass. Rubber and soil (except at very low strains) are non-linear materials. In some embodiments, a material is considered rigid when it adheres to the small deformation theory of elasticity, when subjected to any amount of force in a large range of forces (e.g., between 1 dyne and $10^5$ dynes, between 1000 dynes and $10^6$ dynes, between 10,000 dynes and $10^7$ dynes), such that the material only undergoes small elongations or shortenings or other deformations when subject to such force. The requirement that the deformations (or gradients of deformations) of such exemplary materials are small means, mathematically, that the square of either of these quantities is negligibly small when compared to the first power of the quantities when exposed to such a force. Another way of stating the requirement for a rigid material is that such a material, over a large range of forces (e.g., between 1 dyne and $10^5$ dynes, between 1000 dynes and $10^6$ dynes, between 10,000 dynes and $10^7$ dynes), is well characterized by a strain tensor that only has linear terms. The strain tensor for materials is described in Borg, 1962, *Fundamentals of Engineering Elasticity*, Princeton, N.J., pp. 36-41, which is hereby incorporated by reference herein in its entirety. In some embodiments, a material is considered rigid when a sample of the material of sufficient size and dimensions does not bend under the force of gravity.

Non-planar. The present application is not limited to elongated photovoltaic modules and substrates that have rigid cylindrical shapes or are solid rods. In some embodiments, all or a portion of the substrate 102 can be characterized by a cross-section bounded by any one of a number of shapes other than the circular shape depicted in FIG. 2B. The bounding shape can be any one of circular, ovoid, or any shape characterized by one or more smooth curved surfaces, or any splice of smooth curved surfaces. The bounding shape can be an n-gon, where n is 3, 5, or greater than 5. The bounding shape can also be linear in nature, including triangular, rectangular, pentangular, hexagonal, or having any number of linear segmented surfaces. Or, the cross-section can be bounded by any combination of linear surfaces, arcuate surfaces, or curved surfaces. As described herein, for ease of discussion only, an omni-facial circular cross-section is illustrated to represent non-planar embodiments of the elongated photovoltaic module. However, it should be noted that any cross-sectional geometry may be used in an elongated photovoltaic module.

In some embodiments, a first portion of the substrate 102 is characterized by a first cross-sectional shape and a second portion of the substrate 102 is characterized by a second cross-sectional shape, where the first and second cross-sectional shapes are the same or different. In some embodiments, at least zero percent, at least ten percent, at least twenty percent, at least thirty percent, at least forty percent, at least fifty percent, at least sixty percent, at least seventy percent, at least eighty percent, at least ninety percent or all of the length of the substrate 102 is characterized by the first cross-sectional shape. In some embodiments, the first cross-sectional shape is planar (e.g., has no arcuate side) and the second cross-sectional shape has at least one arcuate side.

Elongated. For purposes of defining the term "elongated," an object (e.g., substrate, elongated photovoltaic module, etc.) is considered to have a width dimension (short dimension, for example diameter of a cylindrical object) and a longitudinal (long) dimension. In some embodiments an object is deemed to be elongated when the longitudinal dimension of the object is at least four times greater than the width dimension. In other embodiments, an object is deemed to be elongated when the longitudinal dimension of the object is at least five times greater than the width dimension. In yet other embodiments, an object is deemed to be elongated when the longitudinal dimension of the object is at least six times greater than the width dimension of the object. In some embodiments, an object is deemed to be elongated when the longitudinal dimension of the object is 100 cm or greater and a cross section of the object includes at least one arcuate edge. In some embodiments, an object is deemed to be elongated when the longitudinal dimension of the object is 100 cm or greater and the object has a cylindrical shape.

6. REFERENCES CITED

All references cited herein are incorporated herein by reference in their entirety and for all purposes to the same extent as if each individual publication or patent or patent application was specifically and individually indicated to be incorporated by reference in its entirety for all purposes.

Many modifications and variations of this application can be made without departing from its spirit and scope, as will be apparent to those skilled in the art. The specific embodiments described herein are offered by way of example only, and the application is to be limited only by the terms of the appended claims, along with the full scope of equivalents to which such claims are entitled.

We claim:

1. A scribing system comprising:

(A) a mounting mechanism that is configured to rotate an elongated object, wherein the elongated object has a middle portion, a first end, and a second end, the elongated object having a long dimension bounded by said first end and said second end, wherein the middle portion of the elongated object is subjected to a bow effect a displacement, at a time when the elongated object is being scribed, relative to the first end and the second end, wherein the displacement is less than ±10% of a length of the long dimension;

(B) a stylus for scribing the elongated object at a position x along the long dimension of the elongated object, while the mounting mechanism rotates the elongated object and thereby subjects said elongated object to said displacement; and (C) a force generating mechanism connected to the stylus so that the stylus applies a force within ±20% of a stated force value to the elongated object regardless of the position x along the long dimension of the elongated object that the stylus is positioned, while the mounting mechanism rotates the elongated object and thereby subjects said elongated object to said displacement, thereby scribing the elongated object.

2. The scribing system of claim 1, wherein the stylus comprises a carbide tip, a diamond coated tip, a stainless steel tip, or a tin nitride coated carbide tip.

3. The scribing system of claim 1, wherein the stated force value is between about 10 grams (g) and about 300 g.

4. The scribing system of claim 1, wherein the elongated object comprises a semiconductor junction that comprises a layer of copper-indium-gallium-diselenide CIGS and a layer of CdS, and the scribing system applies the force to the semiconductor junction through the stylus, and wherein the stated force that is about 80 g.

5. The scribing system of claim 1, wherein the elongated object comprises a transparent conductor layer.

6. The scribing system of claim 5, wherein the scribing system applies the force to the transparent conductor layer through the stylus, and wherein the stated force is about 80 g.

7. The scribing system of claim 1, wherein the force generating mechanism comprises:

an air cylinder;

a piston having a head end and a tail end, wherein the head end of the piston is inside the air cylinder and the tail end of the piston is connected to the stylus; and a control system in communication with the air cylinder such that the control system controls the air pressure inside the air cylinder and thereby applies a constant air pressure to the head end of the piston.

8. The scribing system claim 1, wherein the force generating mechanism comprises:

a spring connected to the stylus; and a control system that applies the force to the spring.

9. The scribing system of claim 8, wherein a direction of the force applied to the spring is parallel to a long dimension of the spring.

10. The scribing system of claim 8, wherein a direction of the force applied to the spring is perpendicular to a long dimension of the spring.

11. The scribing system of claim 1, wherein the force generating mechanism comprises:

a pivot point connected to the stylus; and a pendulum having a first end and a second end, wherein the first end is connected to the pivot point at a point perpendicular to a long dimension of the stylus and the second end of the pendulum comprises a weight.

12. The scribing system of claim 11, wherein the pendulum is horizontal and the gravitational force of the weight provides the force on the elongated object.

13. The scribing system of claim 1, wherein the force generating mechanism comprises:

a motor having a drive shaft; and a rod having a first end and a second end, wherein the first end is connected to the drive shaft and the second end is connected to the stylus.

14. The scribing system of claim 13, wherein a torque produced by the motor provides the force on the elongated object.

15. The scribing system of claim 1, wherein the mounting mechanism is a lathe.

16. The scribing system of claim 1, wherein the elongated object is an elongated photovoltaic module.

17. The scribing system of claim 16, wherein the elongated photovoltaic module has a circular cross-section.

18. The scribing system of claim 16, wherein at least a portion of the elongated photovoltaic module is cylindrical.

19. A mechanical scriber comprising:

an air cylinder;

a stylus;

a piston having a head end and a tail end, wherein the head end of the piston is inside the air cylinder and the tail end of the piston is connected to the stylus; and a control system configured to control an air pressure inside the air cylinder and thereby apply a constant air pressure to the head end of the piston so that the stylus applies a force to an elongated object being scribed by the stylus, wherein the force is within ±20% of a stated force value.

20. A mechanical scriber comprising:

a stylus;

a spring connected to the stylus; and a control system, wherein the control system is configured to apply a first force to the spring thereby allowing the stylus to apply a second force to an elongated object regardless of a position x along a long dimension of the elongated object that the stylus engages the elongated object, wherein the second force is within ±20% of a stated force value, wherein the elongated object has a middle portion, a first end, and a second end, and wherein the constant force mechanical scriber is configured to induce a displacement of the middle portion relative to the first end and the second end while being scribed by the stylus, wherein the displacement is ±10% of a length of the long dimension.

21. The mechanical scriber of claim 20, wherein the elongated object is an elongated photovoltaic module.

22. A mechanical scriber comprising:

a stylus;

a pivot point connected to the stylus; and a pendulum having a first end and a second end, wherein:

i) the first end of the pendulum is connected to the pivot point at a point perpendicular to a long axis of the stylus and the second end of the pendulum comprises a weight; and ii) a gravitational force of the weight allows the stylus to apply a force to an elongated object while the stylus scribes the elongated object, wherein the elongated object has a middle portion, a first end, and a second end, the elongated object having a long dimension bounded by the first end and the second end, wherein the force is within ±20% of a stated force value regardless of which position x along a long dimension of the elongated object that the stylus engages the elongated object and wherein the mechanical scriber is configured to subject the middle portion of the elongated object to a displacement, while being scribed by the stylus, relative to the first end and the second end, wherein the displacement is less than ±10% of the long dimension.

23. The mechanical scriber of claim 22, wherein the elongated object is an elongated photovoltaic module.

24. A mechanical scriber comprising:

a stylus;

a motor having a drive shaft; and a rod having a first end and a second end, wherein:

i) the first end of the rod is connected to the drive shaft and the second end of the rod is connected to the stylus; and ii) the motor is configured to produce a constant torque that allows the stylus to apply a force to an elongated object in order to scribe the elongated object, wherein the elongated object has a middle portion, a first end, and a second end, the elongated object having a long dimension bounded by said first end and said second end, wherein the force is within ±20% of a stated force value regardless of which position x along the long dimension of the elongated object that the stylus engages the elongated object and wherein the constant force mechanical scriber is configured to subject the middle portion of the elongated object to a displacement, while being scribed by the stylus, relative to the first end and the second end, wherein the displacement is less than ±10% of a length of the long dimension.

25. The mechanical scriber of claim 24, wherein the elongated object is an elongated photovoltaic module.

26. A mechanical scriber comprising:

a stylus; and a force generating mechanism connected to the stylus, wherein the force generating mechanism controls the stylus to allow the stylus to apply a force to an elongated object in order to scribe the elongated object, wherein the force is within ±20% of a stated force value regardless of which position x along a long dimension of the elongated object that the stylus engages the elongated object, wherein the elongated object has a middle portion, a first end, and a second end, and wherein the constant force mechanical scriber is configured to subject the middle portion of the elongated object to a displacement while being scribed by the stylus, relative to the first end and the second end wherein the displacement is less than 10% of the long dimension.

27. The mechanical scriber of claim 26, wherein the elongated object is an elongated photovoltaic module.

28. A mechanical scriber, the scriber comprising:

a scribing means for scribing an elongated object; and a control means for controlling the scribing means, wherein the control means is configured to allow the scribing means to apply a force to the elongated object in order to scribe the elongated object that is within ±20% of a stated force value regardless of which position x along a long dimension of the elongated object that the scribing means engages the elongated object, wherein the elongated object has a middle portion, a first end, and a second end, and wherein the constant force mechanical scriber is configured to subject the middle portion of the elongated object to a displacement, while being scribed by the scribing means, relative to the first end and the second end wherein the displacement is less than 10% of the long dimension.

29. The mechanical scriber of claim 28, wherein the elongated object is an elongated photovoltaic module.

30. A method of scribing an elongated object, the method comprising:

(A) rotationally scribing a groove in the elongated object, wherein the elongated object comprises a middle portion, a first end, and a second end, wherein the rotational scribing is achieved by a mechanical scriber capable of scribing the elongated object with a force that is within ±20% of a stated force value regardless of which position x along a long dimension of the elongated object that the scribing means engages the elongated object at a time when the middle portion of the elongated object is subjected to a displacement relative to the first end and the second end of the elongated object, wherein the displacement is less than ±10% of the long dimension.

31. The method of claim 30, wherein the elongated object comprises a semiconductor junction that is rotationally scribed by said rotationally scribing (A) and the elongated object is rotated at a rate of between about 100 RPM and about 1000 RPM.

32. The method of claim 30, wherein the elongated object comprises a transparent conductor layer that is rotationally scribed by said rotationally scribing (A) and the elongated object is rotated at a rate of between about 100 RPM and about 1000 RPM.

33. The method of claim 30, wherein the mechanical scriber comprises:

an air cylinder;

a stylus;

a piston having a head end and a tail end, wherein the head end of the piston is inside the air cylinder and the tail end of the piston is connected to the stylus; and a control system configured to control an air pressure inside the air cylinder and thereby apply a constant air pressure to the head end of the piston so that the stylus applies the force to the elongated object.

34. The method of claim 30, wherein the mechanical scriber comprises:

a stylus;

a spring connected to the stylus; and a control system, wherein the control system is configured to apply a constant force to the spring thereby allowing the stylus to apply the force to the elongated object.

35. The method of claim 30, wherein mechanical scriber comprises:

a stylus;

a pivot point connected to the stylus; and a pendulum having a first end and a second end, wherein:

i) the first end of the pendulum is connected to the pivot point at a point perpendicular to the stylus, and the second end of the pendulum comprises a weight; and ii) a gravitational force of the weight allows the stylus to apply the force to the elongated object.

36. The method of claim 30, wherein the mechanical scriber comprises:

a stylus;

a motor having a drive shaft; and a rod having a first end and a second end, wherein:

i) the first end of the rod is connected to the drive shaft and the second end of the rod is connected to the stylus; and ii) the motor is configured to produce a constant torque that allows the stylus to apply the force to the elongated object.

37. The method of claim 30, wherein the elongated object is an elongated photovoltaic module.

38. The scribing system of claim 1, wherein the displacement is less than ±2% of the length of the long dimension.

39. The scribing system of claim 1, wherein the displacement is less than ±0.2% of the length of the long dimension.

40. The mechanical scriber of claim 20, wherein the displacement is less than ±2% of the length of the long dimension.

41. The mechanical scriber of claim 20, wherein the displacement is less than ±0.2% of the length of the long dimension.

42. The mechanical scriber of claim 22, wherein the displacement is less than ±2% of the length of the long dimension.

43. The mechanical scriber of claim 22, wherein the displacement is less than ±0.2% of the length of the long dimension.

44. The mechanical scriber of claim 24, wherein the displacement is less than ±2% of the length of the long dimension.

45. The mechanical scriber of claim 24, wherein the displacement is less than ±0.2% of the length of the long dimension.

46. The mechanical scriber of claim 26, wherein the displacement is less than ±2% of the length of the long dimension.

47. The mechanical scriber of claim 26, wherein the displacement is less than ±0.2% of the length of the long dimension.

48. The mechanical scriber of claim 28, wherein the displacement is less than ±2% of the length of the long dimension.

49. The mechanical scriber of claim 28, wherein the displacement is less than ±0.2% of the length of the long dimension.

50. The method of claim 30, wherein the displacement is less than ±2% of the length of the long dimension.

51. The method of claim 30, wherein the displacement is less than ±0.2% of the length of the long dimension.

52. The scribing system of claim 1, wherein the force is within ±5% of the stated force value.

53. The scribing system of claim 1, wherein the force is within ±1% of the stated force value.

54. The mechanical scriber of claim 19, wherein the force is within ±5% of the stated force value.

55. The mechanical scriber of claim 19, wherein the force is within ±1% of the stated force value.

56. The mechanical scriber of claim 20, wherein the second force is within ±5% of the stated force value.

57. The mechanical scriber of claim 20, wherein the second force is within ±1% of the stated force value.

58. The mechanical scriber of claim 22, wherein the force is within ±5% of the stated force value.

59. The mechanical scriber of claim 22, wherein the force is within ±1% of the stated force value.

60. The mechanical scriber of claim 24, wherein the force is within ±5% of the stated force value.

61. The mechanical scriber of claim 24, wherein the force is within ±1% of the stated force value.

62. The mechanical scriber of claim 26, wherein the force is within ±5% of the stated force value.

63. The mechanical scriber of claim 26, wherein the force is within ±1% of the stated force value.

64. The mechanical scriber of claim 28, wherein the force is within ±5% of the stated force value.

65. The mechanical scriber of claim 28, wherein the force is within ±1% of the stated force value.

66. The method of claim 30, wherein the force is within ±5% of the stated force value.

67. The method of claim 30, wherein the force is within ±1% of the stated force value.

* * * * *